US010894401B2

(12) United States Patent
Kamiyanagi et al.

(10) Patent No.: US 10,894,401 B2
(45) Date of Patent: Jan. 19, 2021

(54) LIQUID EJECTING APPARATUS, PRINT HEAD, AND LIQUID EJECTING METHOD

(71) Applicant: SEIKO EPSON CORPORATION, Tokyo (JP)

(72) Inventors: Masashi Kamiyanagi, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/689,160

(22) Filed: Nov. 20, 2019

(65) Prior Publication Data

US 2020/0164632 A1 May 28, 2020

(30) Foreign Application Priority Data

Nov. 22, 2018 (JP) ..... 2018-219357

(51) Int. Cl.
*B41J 2/045* (2006.01)
*B41J 2/14* (2006.01)

(52) U.S. Cl.
CPC ..... *B41J 2/0451* (2013.01); *B41J 2/04541* (2013.01); *B41J 2/04581* (2013.01); *B41J 2/04588* (2013.01); *B41J 2/04593* (2013.01); *B41J 2/04596* (2013.01); *B41J 2/14314* (2013.01); *B41J 2002/14354* (2013.01)

(58) Field of Classification Search
CPC .. B41J 2/0451; B41J 2/04541; B41J 2/04581; B41J 2/04588; B41J 2/04593; B41J 2/04596; B41J 2/14314; B41J 2002/14354
See application file for complete search history.

(56) References Cited

U.S. PATENT DOCUMENTS 7,150,513 B2 * 12/2006 Shinkawa ..... B41J 2/0458 347/23
9,085,134 B2 * 7/2015 Otokita ..... B41J 2/14233
9,724,914 B2 * 8/2017 Fujisawa ..... B41J 2/14233
2004/0223027 A1 11/2004 Shinkawa et al.
2016/0167364 A1 * 6/2016 Matsumoto ..... B41J 2/04588 347/9

FOREIGN PATENT DOCUMENTS

JP 2013-028183 A 2/2013

* cited by examiner

*Primary Examiner* — Anh T Vo
(74) *Attorney, Agent, or Firm* — Global IP Counselors, LLP

(57) ABSTRACT

A liquid ejecting apparatus includes a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, specifies a cause of the ejecting malfunction based on the residual vibration signal. The ejecting malfunction detection circuit includes a detection unit detecting the residual vibration signal, an obtaining unit obtaining information indicating an ejecting state of the liquid ejected from the nozzle, and a learning unit machine learning a relationship between the residual vibration signal and the ejecting state.

18 Claims, 23 Drawing Sheets

FIG. 16

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

FIG. 22

| Flag | NTc (COMPARISON CONTENT) | Rs |
|---|---|---|
| 1 | NTc<NTx1 | 2: EJECTING MALFUNCTION (AIR BUBBLE) |
| | NTx1≤NTc≤NTx2 | 1: NORMALITY |
| | NTx2<NTc≤NTx3 | 3: EJECTING MALFUNCTION (PAPER DUST) |
| | NTx3<NTc | 4: EJECTING MALFUNCTION (THICKENING) |
| 0 | N/A | 5: EJECTING MALFUNCTION |

LIQUID EJECTING APPARATUS, PRINT HEAD, AND LIQUID EJECTING METHOD

The present application is based on, and claims priority from JP Application Serial Number 2018-219357, filed Nov. 22, 2018, the disclosure of which is hereby incorporated by reference herein in its entirety.

BACKGROUND

1. Technical Field

The present disclosure relates to a liquid ejecting apparatus, a print head, and a liquid ejecting method.

2. Related Art

A liquid ejecting apparatus such as an ink jet printer ejects ink filling a print head from a nozzle and forms an image on a recording medium by driving a drive element such as a piezoelectric element disposed in an ejecting unit using a drive signal.

However, when ink filling the print head thickens, an ejecting malfunction occurs, and the image quality of the printed image is decreased. Furthermore, for example, when an air bubble enters into the print head, or paper dust clings around the nozzle, the ejecting malfunction of ink ejected from the nozzle may occur. Consequently, the ejecting accuracy of ink may be decreased, and the image quality of the image printed on the medium may be decreased. Thus, in order to implement high quality printing, it is desirable to inspect the ejecting state of ink in the print head.

JP-A-2013-028183 discloses a method of detecting residual vibration that is caused by driving the piezoelectric element using the drive signal, and inspecting the ejecting state of ink in the ejecting unit based on the detection result.

In the disclosure of JP-A-2013-028183, a determination as to whether or not ink is normally ejected is performed based on whether or not the cycle of the detected residual vibration is within a detection threshold that is set in advance. Thus, in the setting of the detection threshold, for example, it is necessary to consider (1) a design error of a liquid ejecting apparatus 1, (2) an environment such as a temperature and a humidity at which the liquid ejecting apparatus is used, (3) a change in characteristics accompanied by a temporal change in various configurations constituting the liquid ejecting apparatus, and (4) physical properties such as the viscosity of the used ink. Accordingly, it is difficult to set an optimal detection threshold for individual liquid ejecting apparatuses. Thus, the inspection accuracy of the ejecting state of ink may be decreased.

SUMMARY

According to an aspect of the present disclosure, a liquid ejecting apparatus includes a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal. The ejecting malfunction detection circuit includes a detection unit detecting the residual vibration signal, an obtaining unit obtaining information indicating an ejecting state of the liquid ejected from the nozzle, and a learning unit machine learning a relationship between the residual vibration signal and the ejecting state.

In the liquid ejecting apparatus, the learning unit may generate a learning threshold signal indicating the presence or absence of the ejecting malfunction of the liquid ejecting head based on the relationship, obtained by machine learning, between the residual vibration signal and the ejecting state.

In the liquid ejecting apparatus, the ejecting malfunction detection circuit may include a waveform shaping unit, a measuring unit, and a determination unit. The waveform shaping unit may generate a shaped waveform signal obtained by removing a noise component from the residual vibration signal. The measuring unit may measure a cycle of the residual vibration signal based on the shaped waveform signal. The determination unit may detect the presence or absence of the ejecting malfunction and specify the cause of the ejecting malfunction based on a cycle of the shaped waveform signal and a predetermined threshold. The predetermined threshold may be updated based on the learning threshold signal.

According to another aspect of the present disclosure, a liquid ejecting apparatus includes a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal. The ejecting malfunction detection circuit includes a detection unit detecting the residual vibration signal, a storage unit storing a learning model obtained by machine learning a relationship between the residual vibration signal and an ejecting state of the liquid ejected from the nozzle, and a determination unit determining the presence or absence of the ejecting malfunction of the liquid ejecting head based on the residual vibration signal and the learning model.

In the liquid ejecting apparatus, the ejecting malfunction detection circuit may include a waveform shaping unit, a measuring unit, and a determination unit. The waveform shaping unit may generate a shaped waveform signal obtained by removing a noise component from the residual vibration signal. The measuring unit may measure a cycle of the residual vibration signal based on the shaped waveform signal. The determination unit may detect the presence or absence of the ejecting malfunction and specify the cause of the ejecting malfunction based on a cycle of the shaped waveform signal and a predetermined threshold. The predetermined threshold may be updated based on the residual vibration signal and the learning model.

In the liquid ejecting apparatus, the determination unit may specify, as the cause of the ejecting malfunction, at least one of air bubble entrance in which an air bubble enters into the cavity, dry thickening in which the liquid around the nozzle dries and thickens, and paper dust clinging in which paper dust clings around an outlet of the nozzle.

In the liquid ejecting apparatus, the determination unit may include, as the predetermined threshold, a first threshold, a second threshold set in a cycle longer than the first threshold, and a third threshold set in a cycle longer than the second threshold. When the cycle of the residual vibration signal is less than the first threshold, the determination unit may determine that the cause of the ejecting malfunction is the air bubble entrance. When the cycle of the residual vibration signal exceeds the second threshold and is less than or equal to the third threshold, the determination unit may determine that the cause of the ejecting malfunction is the paper dust clinging. When the cycle of the residual vibration signal exceeds the third threshold, the determination unit may determine that the cause of the ejecting malfunction is the dry thickening.

The liquid ejecting apparatus may further include an ejecting selection circuit that is electrically coupled to the drive element and that selects whether or not to supply the drive waveform signal to the drive element, a switching circuit electrically coupled to the liquid ejecting head, the ejecting selection circuit, and the ejecting malfunction detection circuit, and a recovery mechanism executing a recovery process for recovery from the ejecting malfunction. The switching circuit may switch between electrically coupling the liquid ejecting head to the ejecting selection circuit and electrically coupling the liquid ejecting head to the ejecting malfunction detection circuit.

In the liquid ejecting apparatus, the recovery mechanism, as the recovery process, may execute, when the cause of the ejecting malfunction is the air bubble entrance, a pump suction process of coupling a pump to a cap covering a nozzle surface on which the nozzle of the liquid ejecting head is provided, and performing suction, may execute, when the cause of the ejecting malfunction is the dry thickening, the pump suction process or a flushing process of ejecting the liquid from the nozzle by driving the drive element for cleaning the liquid ejecting head, and may execute, when the cause of the ejecting malfunction is the paper dust clinging, a wiping process of wiping the nozzle surface of the liquid ejecting head.

In the liquid ejecting apparatus, the recovery mechanism may execute the recovery process on a malfunctioning nozzle in which the ejecting malfunction is detected in the ejecting malfunction detection circuit. The vibration plate corresponding to the malfunctioning nozzle may be displaced after the execution of the recovery process. The ejecting malfunction detection circuit may detect the presence or absence of the ejecting malfunction of the malfunctioning nozzle again based on the residual vibration signal generated by the displacement of the vibration plate corresponding to the malfunctioning nozzle.

In the liquid ejecting apparatus, the recovery mechanism may execute the flushing process on a malfunctioning nozzle in which the ejecting malfunction is detected in the ejecting malfunction detection circuit. The vibration plate corresponding to the malfunctioning nozzle may be displaced after the execution of the flushing process. The ejecting malfunction detection circuit may detect the presence or absence of the ejecting malfunction of the malfunctioning nozzle again and specify the cause of the ejecting malfunction based on the residual vibration signal generated by the displacement of the vibration plate corresponding to the malfunctioning nozzle. The recovery mechanism may execute the recovery process corresponding to the cause of the ejecting malfunction specified by the ejecting malfunction detection circuit in the detection performed again.

In the liquid ejecting apparatus, a plurality of the liquid ejecting heads, a plurality of the ejecting malfunction detection circuits, and a plurality of the switching circuits may be provided. A first ejecting malfunction detection circuit of the plurality of ejecting malfunction detection circuits may detect the presence or absence of the ejecting malfunction of the nozzle included in a first liquid ejecting head of the plurality of liquid ejecting heads and specify the cause of the ejecting malfunction. A first switching circuit of the plurality of switching circuits may switch between electrically coupling the first liquid ejecting head to the ejecting selection circuit and electrically coupling the first liquid ejecting head to the first ejecting malfunction detection circuit. A second ejecting malfunction detection circuit of the plurality of ejecting malfunction detection circuits may detect the presence or absence of the ejecting malfunction of the nozzle included in a second liquid ejecting head of the plurality of liquid ejecting heads and specify the cause of the ejecting malfunction. A second switching circuit of the plurality of switching circuits may switch between electrically coupling the second liquid ejecting head to the ejecting selection circuit and electrically coupling the second liquid ejecting head to the second ejecting malfunction detection circuit. The ejecting selection circuit may select whether or not to supply the drive waveform signal to each of the drive element included in the first liquid ejecting head and the drive element included in the second liquid ejecting head. The detection of the presence or absence of the ejecting malfunction of the nozzle included in the first liquid ejecting head and the specifying of the cause of the ejecting malfunction in the first ejecting malfunction detection circuit may be performed in parallel with the detection of the presence or absence of the ejecting malfunction of the nozzle included in the second liquid ejecting head and the specifying of the cause of the ejecting malfunction in the second ejecting malfunction detection circuit.

In the liquid ejecting apparatus, the recovery mechanism may execute the recovery process on the first liquid ejecting head depending on the cause of the ejecting malfunction detected by the first ejecting malfunction detection circuit, and execute the recovery process on the second liquid ejecting head depending on the cause of the ejecting malfunction detected by the second ejecting malfunction detection circuit.

In the liquid ejecting apparatus, the ejecting malfunction detection circuit may detect the presence or absence of the ejecting malfunction and specify the cause of the ejecting malfunction during an ejecting operation of ejecting the liquid from the nozzle.

According to still another aspect of the present disclosure, a print head includes a liquid ejecting head including a vibration plate, a drive element displacing the vibration plate by being supplied with a drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal. The ejecting malfunction detection circuit includes a detection unit detecting the residual vibration signal, an obtaining unit obtaining information indicating an ejecting state of the liquid ejected from the nozzle, and a learning unit machine learning a relationship between the residual vibration signal and the ejecting state.

According to still another aspect of the present disclosure, a print head includes a liquid ejecting head including a vibration plate, a drive element displacing the vibration plate by being supplied with a drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal. The ejecting malfunction detection circuit includes a detection unit detecting the residual vibration signal, a storage unit storing a learning model obtained by machine learning a relationship between the residual vibration signal and an ejecting state of the liquid ejected from the nozzle, and a determination unit determining the presence or absence of the ejecting malfunction of the liquid ejecting head based on the residual vibration signal and the learning model.

According to still another aspect of the present disclosure, a liquid ejecting method is a liquid ejecting method of a liquid ejecting apparatus including a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal. The method includes, by the ejecting malfunction detection circuit, detecting the residual vibration signal, obtaining information indicating an ejecting state of the liquid ejected from the nozzle, and machine learning a relationship between the residual vibration signal and the ejecting state.

According to still another aspect of the present disclosure, a liquid ejecting method is a liquid ejecting method of a liquid ejecting apparatus including a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal. The method includes, by the ejecting malfunction detection circuit, detecting the residual vibration signal, storing a learning model obtained by machine learning a relationship between the residual vibration signal and an ejecting state of the liquid ejected from the nozzle, and determining the presence or absence of the ejecting malfunction of the liquid ejecting head based on the residual vibration signal and the learning model.

BRIEF DESCRIPTION OF THE DRAWINGS

FIG. 16 is a diagram illustrating a content of decoding performed by a decoder.

FIG. 22 is a diagram for describing a content of determination in a determination unit.

DESCRIPTION OF EXEMPLARY EMBODIMENTS

Hereinafter, exemplary embodiments of the present disclosure will be described using the drawings. The drawings are used for convenience of description. The embodiments described below do not unduly limit the content of the present disclosure disclosed in the claims. In addition, not all configurations described below are essential constituents of the present disclosure. In the present embodiments, an ink jet printer that forms an image on a medium P by ejecting ink as one example of a liquid will be illustratively described as a liquid ejecting apparatus.

1. First Embodiment

1.1 Configuration of Liquid Ejecting Apparatus

Figure 1:
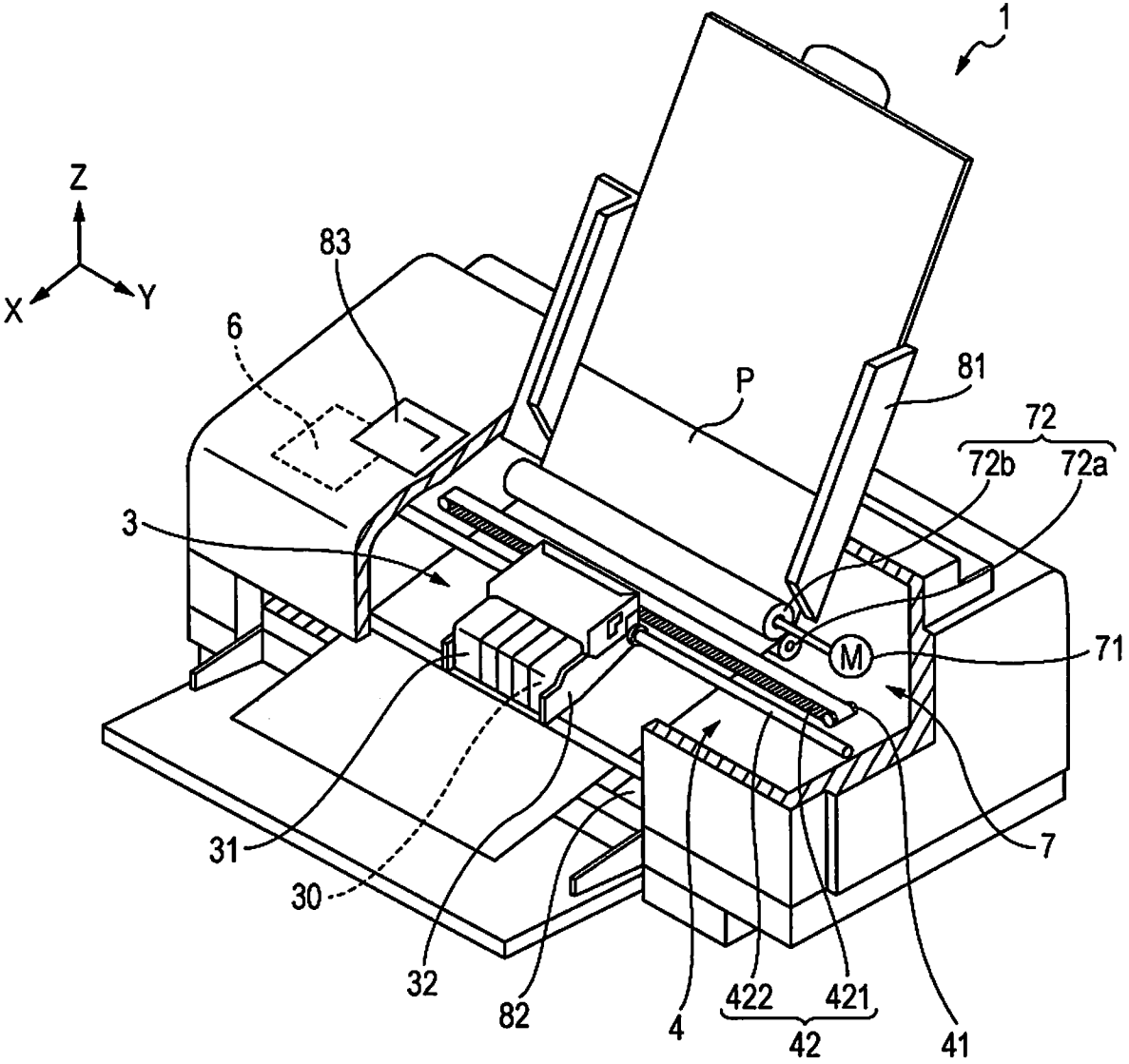
FIG. 1 is a perspective view illustrating a summary of a configuration of a liquid ejecting apparatus.

First, a configuration of a liquid ejecting apparatus 1 will be described. FIG. 1 is a perspective view illustrating a summary of the configuration of the liquid ejecting apparatus 1 according to the present embodiment. In the following description, an upper side (+Z direction) in FIG. 1 may be referred to as an "upper part", and a lower side (−Z direction) in FIG. 1 may be referred to as a "lower part".

As illustrated in FIG. 1, in the liquid ejecting apparatus 1, a tray 81 in which the medium P is set is disposed in an upper rear part. A paper discharge port 82 from which the medium P is discharged is disposed in a lower front part. An operation panel 83 is disposed on an upper surface.

For example, the operation panel 83 is configured with a liquid crystal display, an organic EL display, or an LED lamp and includes a display unit, not illustrated, displaying an error message and the like and an operation unit, not illustrated, configured with various switches and the like. The display unit of the operation panel 83 functions as a notification section.

In addition, as illustrated in FIG. 1, the liquid ejecting apparatus 1 includes a printing section 4 that includes a reciprocating moving object 3.

The moving object 3 includes a head unit 30, four ink cartridges 31, and a carriage 32 on which the head unit 30 and the four ink cartridges 31 are mounted. The head unit 30 includes a plurality of liquid ejecting heads 35 described below. Each liquid ejecting head 35 is filled with ink supplied from the ink cartridges 31 and can eject ink filling the liquid ejecting head 35. In addition, the four ink cartridges 31 are disposed in one-to-one correspondence with four colors of yellow, cyan, magenta, and black. Each ink cartridge 31 is filled with ink of a color corresponding to the ink cartridge 31. Each of the plurality of liquid ejecting heads 35 is supplied with ink from any one of the four ink cartridges 31. Accordingly, ink of four colors can be ejected from the plurality of liquid ejecting heads 35 as a whole, and full color printing is implemented.

The liquid ejecting apparatus 1 according to the present embodiment includes the four ink cartridges 31 corresponding to ink of the four colors. However, the present disclosure is not limited to such an aspect and may further include the ink cartridge 31 filled with ink of a color different from the four colors or may include only the ink cartridge 31 corresponding to a part of the four colors. In addition, each ink cartridge 31 may be disposed at another location in the liquid ejecting apparatus 1 instead of being mounted on the carriage 32.

As illustrated in FIG. 1, the printing section 4 includes a carriage motor 41 and a reciprocation mechanism 42. The carriage motor 41 is a drive source for reciprocating the moving object 3 in a main scan direction. The reciprocation mechanism 42 reciprocates the moving object 3 by receiving rotation of the carriage motor 41. The main scan direction is a direction in which an Y axis extends in FIG. 1. The reciprocation mechanism 42 includes a carriage guide shaft 422 and a timing belt 421. Both ends of the carriage guide shaft 422 are supported by a frame not illustrated. The timing belt 421 extends parallel to the carriage guide shaft 422. The carriage 32 of the moving object 3 is supported by the carriage guide shaft 422 of the reciprocation mechanism 42 in a reciprocating manner and is fixed to a part of the timing belt 421. Thus, when the timing belt 421 is traveled normally or reversely through a pulley by the operation of the carriage motor 41, the moving object 3 reciprocates while being guided by the carriage guide shaft 422.

In addition, as illustrated in FIG. 1, the liquid ejecting apparatus 1 includes a paper feeding device 7 that supplies and discharges the medium P to and from the printing section 4.

The paper feeding device 7 includes a paper feeding motor 71 as a drive source of the paper feeding device 7 and a paper feeding roller 72 that rotates by the operation of the paper feeding motor 71. The paper feeding roller 72 is configured with a passive roller 72*a* and a drive roller 72*b* that face each other in an up-down direction with the medium P interposed therebetween in a transport path of the medium P. The drive roller 72*b* is coupled to the paper feeding motor 71. Accordingly, the paper feeding roller 72 transports a plurality of sheets of the medium P set in the tray 81 to the printing section 4 one sheet at a time or discharges the plurality of sheets of the medium P from the printing section 4 one sheet at a time. A configuration in which a paper feeding cassette accommodating the medium P can be attachably and detachably mounted may be used instead of the tray 81.

In addition, as illustrated in FIG. 1, the liquid ejecting apparatus 1 includes a control unit 6 that controls the printing section 4 and the paper feeding device 7.

The control unit 6 performs a printing process on the medium P by controlling the printing section 4, the paper feeding device 7, and the like based on image data Img that is input from a host computer 9, described below, such as a personal computer or a digital camera.

Specifically, the control unit 6 intermittently transports the medium P in a subscan direction one sheet at a time by controlling the paper feeding device 7. The subscan direction is an X axis direction. In addition, the control unit 6 controls the moving object 3 to reciprocate in the main scan direction that is the Y axis direction intersecting with the subscan direction. That is, the control unit 6 executes the printing process on the medium P by controlling the moving object 3 to reciprocate in the main scan direction, controlling the paper feeding device 7 to intermittently transport the medium P in the subscan direction, and controlling driving of the head unit 30 to eject or not eject ink from each liquid ejecting head 35 based on the image data Img.

The control unit 6 displays the error message and the like on the display unit of the operation panel 83 or turns on/flashes the LED lamp or the like. The control unit 6 causes each unit to execute a corresponding process based on press signals of various switches input from the operation unit of the operation panel 83. Furthermore, when necessary, the control unit 6 may execute a process of transferring information related to the error message, an ejecting malfunction, and the like to the host computer 9.

Figure 2:
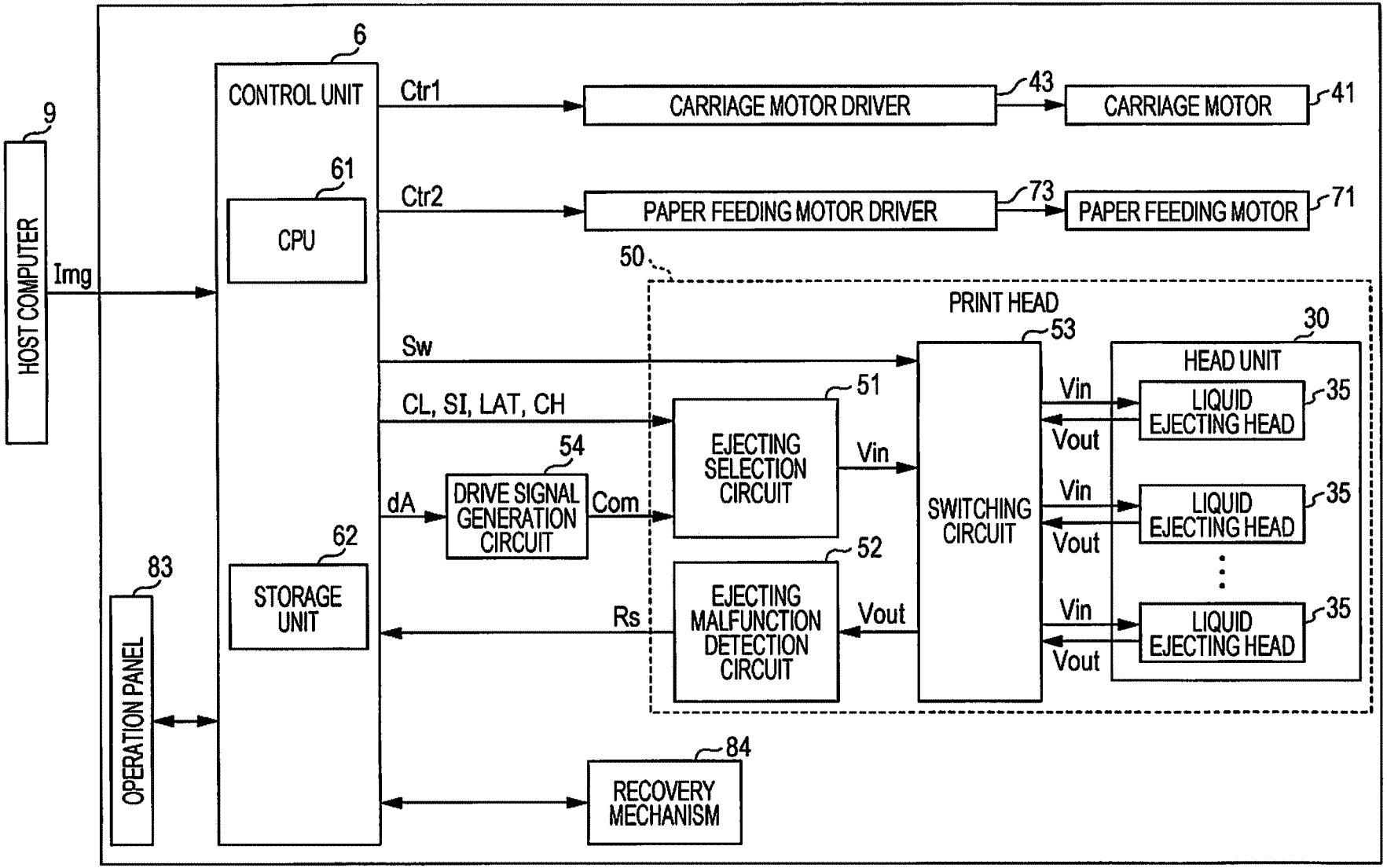
FIG. 2 is a diagram illustrating an electrical configuration of the liquid ejecting apparatus.

FIG. 2 is a diagram illustrating an electrical configuration of the liquid ejecting apparatus 1 according to the present embodiment. As illustrated in FIG. 2, the liquid ejecting apparatus 1 includes the control unit 6, a print head 50, a drive signal generation circuit 54, the operation panel 83, a recovery mechanism 84, the carriage motor 41, a carriage motor driver 43, the paper feeding motor 71, and a paper feeding motor driver 73.

The control unit 6 controls the operation of each unit of the liquid ejecting apparatus 1. As illustrated in FIG. 2, the control unit 6 includes a CPU 61 and a storage unit 62.

The storage unit 62 includes an electrically erasable programmable read-only memory (EEPROM) that is one kind of non-volatile semiconductor memory and stores, in a data storage area, the image data Img supplied from the host computer 9 through an interface unit not illustrated. In addition, the storage unit 62 includes a random access memory (RAM), not illustrated, that temporarily stores data necessary for executing various processes such as the printing process or in which a control program for executing various processes such as the printing process is temporarily loaded. In addition, the storage unit 62 includes a PROM, not illustrated, that is one kind of non-volatile semiconductor memory and stores the control program and the like controlling each unit of the liquid ejecting apparatus 1.

The CPU 61 stores the image data Img supplied from the host computer 9 in the storage unit 62. In addition, based on various data such as the image data Img stored in the storage unit 62, the CPU 61 generates and outputs various signals such as a driver control signal Ctr1 for controlling the operation of the carriage motor driver 43, a driver control signal Ctr2 for controlling the operation of the paper feeding motor driver 73, a base drive signal dA for controlling the drive signal generation circuit 54, a clock signal CL for controlling the print head 50, a printing signal SI, a latch signal LAT, a change signal CH, and a switching control signal Sw, a signal for controlling the operation of the recovery mechanism 84, and a signal for controlling the operation of the operation panel 83.

The carriage motor driver 43 drives the carriage motor 41 based on the driver control signal Ctr1. Accordingly, the carriage motor 41 reciprocates the head unit 30. The paper feeding motor driver 73 drives the paper feeding motor 71 based on the driver control signal Ctr2. Accordingly, the paper feeding motor 71 transports the medium P.

The drive signal generation circuit 54 generates a drive waveform signal Com based on the base drive signal dA supplied from the control unit 6. The base drive signal dA is a digital signal that defines the signal waveform of the drive waveform signal Com. The drive signal generation circuit 54 generates the drive waveform signal Com by performing digital/analog conversion of the base drive signal dA and amplifying the signal. Then, the drive signal generation circuit 54 outputs the drive waveform signal Com to an ejecting selection circuit 51. While details will be described below, the drive signal generation circuit 54 in the present embodiment generates three drive waveform signals Com-A, Com-B, and Com-C as the drive waveform signal Com.

The print head 50 includes the ejecting selection circuit 51, an ejecting malfunction detection circuit 52, a switching circuit 53, and the head unit 30.

The ejecting selection circuit 51 is electrically coupled to piezoelectric elements 200, described below, and selects whether or not to supply the drive waveform signal Com to the piezoelectric elements 200. The ejecting selection circuit 51 generates a drive signal Vin for driving the liquid ejecting heads 35 included in the head unit 30 based on the clock signal CL, the printing signal SI, the latch signal LAT, and the change signal CH supplied from the control unit 6 and the drive waveform signal Com supplied from the drive signal generation circuit 54.

The ejecting malfunction detection circuit 52 detects a change in internal pressure as a residual vibration signal Vout. The change in internal pressure is caused by vibration and the like of ink inside the liquid ejecting heads 35 after the liquid ejecting heads 35 are driven by the drive signal Vin. In addition, the ejecting malfunction detection circuit 52 determines the ejecting state of ink in the liquid ejecting heads 35 based on the residual vibration signal Vout, and outputs a determination result signal Rs that represents the determination result. For example, the ejecting state of ink indicates whether or not an ejecting malfunction is present in the liquid ejecting heads 35.

The switching circuit 53 is electrically coupled to the liquid ejecting heads 35, the ejecting selection circuit 51, and the ejecting malfunction detection circuit 52. The switching circuit 53 electrically couples each liquid ejecting head 35 to any one of the ejecting selection circuit 51 or the ejecting malfunction detection circuit 52 based on the switching control signal Sw supplied from the control unit 6. In other words, the switching circuit 53 switches between electrically coupling the liquid ejecting heads 35 to the ejecting selection circuit 51 and electrically coupling the liquid ejecting heads 35 to the ejecting malfunction detection circuit 52 based on the switching control signal Sw.

The recovery mechanism 84 executes a recovery process for recovering from the ejecting malfunction present in the liquid ejecting heads 35 based on the determination result signal Rs that indicates the determination result of the ejecting state of ink and that is output from the ejecting malfunction detection circuit 52. The recovery process is a collective term for processes for returning, to a normal state, the ejecting state of ink of the liquid ejecting heads 35 in which the ejecting malfunction of ink is found. Such processes include a pump suction process of coupling a pump to a cap covering a nozzle surface on which nozzles N of the liquid ejecting heads 35 are provided and performing suction, a flushing process of ejecting ink from the nozzles N by driving the piezoelectric elements 200, described below, included in the liquid ejecting heads for cleaning the liquid ejecting heads 35, and a wiping process of wiping the nozzle surface on which the nozzles N are provided in the liquid ejecting heads 35. From the pump suction process, the flushing process, the wiping process, and the like, the control unit 6 selects one or more than two recovery processes appropriate for recovering from the ejecting state of the liquid ejecting heads 35 based on the determination result signal Rs input from the ejecting malfunction detection circuit 52. The control unit 6 causes the recovery mechanism 84 to execute the selected recovery process. Details of the recovery mechanism 84 will be described below.

1.2 Configuration of Head Unit

Figure 3:
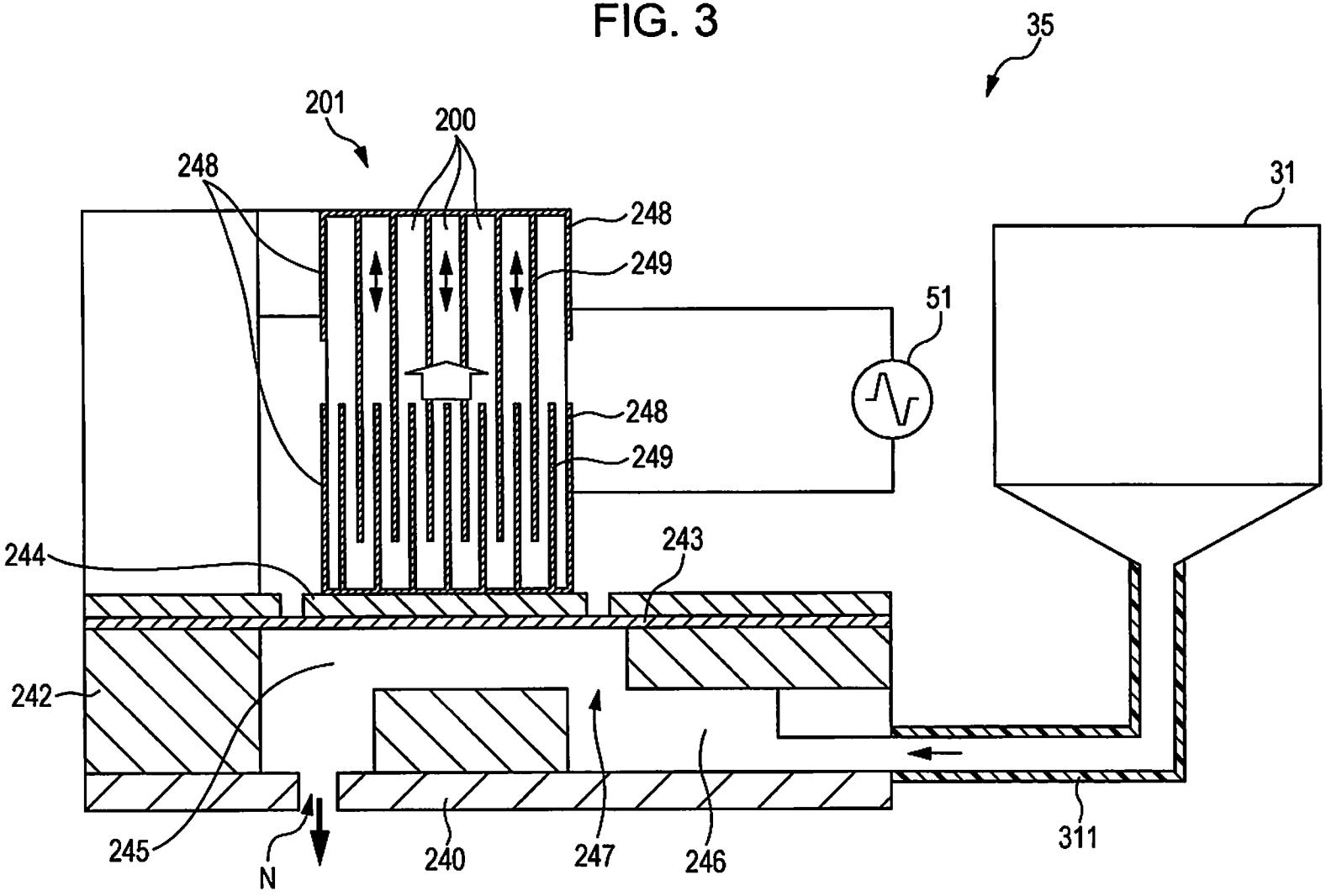
FIG. 3 is a schematic sectional view of one example of a liquid ejecting head included in a head unit.

Next, configurations of the head unit 30 and the liquid ejecting heads 35 included in the head unit 30 will be described using FIG. 3 and FIG. 4. FIG. 3 is a schematic sectional view of each liquid ejecting head 35 included in the head unit 30. In the liquid ejecting head 35 illustrated in FIG. 3, ink inside a cavity 245 is ejected from the nozzle N by driving the piezoelectric elements 200. The liquid ejecting head 35 includes a vibration plate 243, the piezoelectric elements 200, the cavity 245, the nozzle N, and a piezoelectric element stack 201. The piezoelectric elements 200 are one example of a drive element that displaces the vibration plate 243 by being supplied with the drive waveform signal Com. The cavity 245 is filled with ink and has a change in internal pressure caused by the displacement of the vibration plate 243. The nozzle N communicates with the cavity 245 and ejects ink by the change in internal pressure of the cavity 245. The piezoelectric element stack 201 is formed by stacking a plurality of piezoelectric elements 200.

For example, a cavity plate 242 is molded in a predetermined shape in which recess portions are formed. Accordingly, the cavity 245 and a reservoir 246 are formed. The cavity 245 and the reservoir 246 communicate with each other through an ink supply port 247. The reservoir 246 communicates with the ink cartridge 31 through an ink supply tube 311.

In FIG. 3, the lower end of the piezoelectric element stack 201 is joined to the vibration plate 243 through an intermediate layer 244. In the piezoelectric element stack 201, a plurality of external electrodes 248 and a plurality of internal electrodes 249 are joined. That is, the external electrodes 248 are joined on the outer surface of the piezoelectric element stack 201, and the internal electrodes 249 are installed between the piezoelectric elements 200 constituting the piezoelectric element stack 201 or inside the piezoelectric elements. In this case, the external electrodes 248 and the internal electrodes 249 are alternately arranged in partial overlap in the thickness direction of the piezoelectric elements 200.

The piezoelectric element stack 201 expands and contracts in the up-down direction as illustrated by arrows in FIG. 3 and vibrates by supplying the drive signal Vin between the external electrodes 248 and the internal electrodes 249 from the ejecting selection circuit 51. This vibration causes the vibration plate 243 to vibrate. The vibration of the vibration plate 243 changes the capacity of the cavity 245. The internal pressure of the cavity 245 changes along with the change in capacity of the cavity 245, and ink filling the cavity 245 is ejected from the nozzle N. When ink in the cavity 245 is decreased by the ejection of ink, ink is supplied from the reservoir 246. Ink is supplied to the reservoir 246 from the ink cartridge 31 through the ink supply tube 311.

Figure 4:
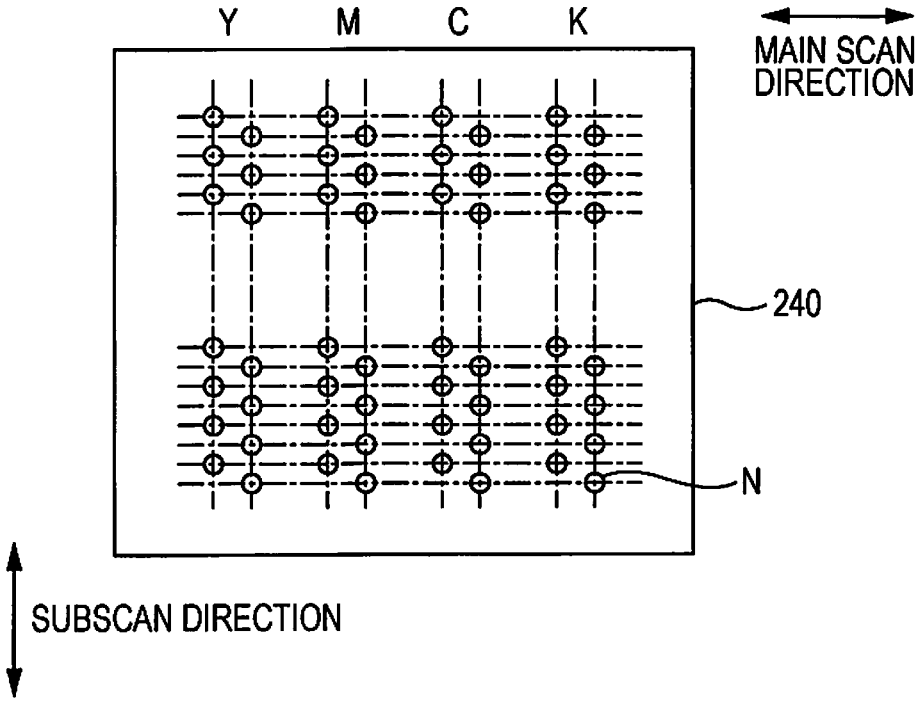
FIG. 4 is a diagram illustrating one example of an arrangement pattern of nozzles.

FIG. 4 is a diagram illustrating one example of an arrangement pattern of the nozzles N formed in a nozzle plate 240. The nozzles N formed in the nozzle plate 240 illustrated in FIG. 3 are arranged such that stages of the nozzles N deviate from each other as illustrated in FIG. 4. The pitch between the nozzles N may be appropriately set depending on a printing resolution (dot per inch (dpi)). In FIG. 4, the arrangement pattern of the nozzles N when ink (ink cartridges) of the four colors is applied is illustrated.

Next, a configuration of a liquid ejecting head 35A as another example of the liquid ejecting head 35 will be described. In the liquid ejecting head 35A illustrated in FIG. 5, a vibration plate 262 vibrates by driving the piezoelectric element 200, and ink inside a cavity 258 is ejected from the nozzle N. A metal plate 254 of stainless steel is joined through an adhesive film 255 to a nozzle plate 252 of stainless steel in which the nozzle N is formed. The same metal plate 254 of stainless steel is further joined on the metal plate 254 through the adhesive film 255. Then, a communication port forming plate 256 and a cavity plate 257 are jointed on the metal plate 254 in this order.

Each of the nozzle plate 252, the metal plate 254, the adhesive film 255, the communication port forming plate 256, and the cavity plate 257 is molded in a predetermined shape in which recess portions are formed. The cavity 258 and a reservoir 259 are formed by overlapping the nozzle plate 252, the metal plate 254, the adhesive film 255, the communication port forming plate 256, and the cavity plate 257. The cavity 258 and the reservoir 259 communicate with each other through an ink supply port 260. The reservoir 259 communicates with an ink supply port 261.

The vibration plate 262 is installed in an opening portion on the upper surface of the cavity plate 257. The piezoelectric element 200 is joined to the vibration plate 262 through a lower electrode 263. An upper electrode 264 is joined on the side of the piezoelectric element 200 opposite to the lower electrode 263. The ejecting selection circuit 51 supplies the drive signal Vin between the upper electrode 264 and the lower electrode 263. Thus, the piezoelectric element 200 vibrates, and the vibration plate 262 joined to the piezoelectric element 200 vibrates. The vibration of the vibration plate 262 changes the capacity of the cavity 258. The internal pressure of the cavity 258 changes along with the change in capacity of the cavity 258, and ink filling the cavity 258 is ejected from the nozzle N.

When the amount of ink inside the cavity 258 is decreased by the ejection of ink, ink is supplied from the reservoir 259. Ink is supplied to the reservoir 259 from the ink supply port 261.

Figure 6A:
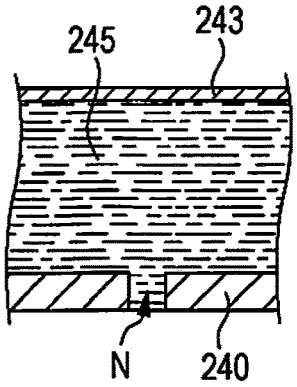
FIGS. 6A to 6C are diagrams for describing an ink ejecting operation.
Figure 6B:
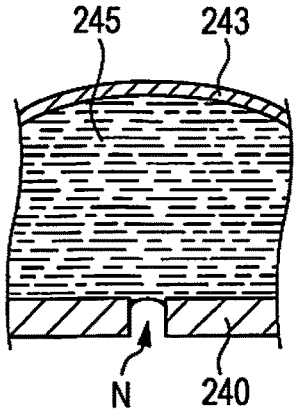
Figure 6C:
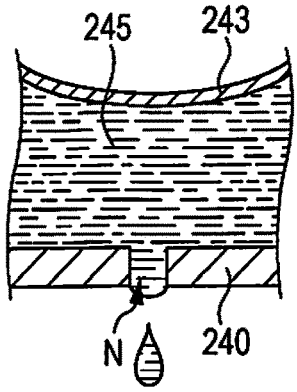

Next, the ejection of ink will be described with reference to FIGS. 6A to 6C. FIGS. 6A to 6C are diagrams for describing an ink ejecting operation. When the drive signal Vin is supplied to the piezoelectric elements 200 illustrated in FIG. 3 from the ejecting selection circuit 51, a distortion that is proportional to an electric field applied between the electrodes occurs. The vibration plate 243 bends in the upward direction of FIG. 3 from an initial state illustrated in FIG. 6A, and the capacity of the cavity 245 is increased as illustrated in FIG. 6B. In this state, when a voltage indicated by the drive signal Vin is changed under control of the ejecting selection circuit 51, the vibration plate 243 is restored by the elastic restoring force of the vibration plate 243 and moves in the downward direction beyond the position of the vibration plate 243 in the initial state. The capacity of the cavity 245 is rapidly decreased as illustrated in FIG. 6C. At this point, a compressive pressure that occurs in the cavity 245 causes a part of ink filling the cavity 245 to be ejected from the nozzle N communicating with the cavity 245.

After this series of ink ejecting operations is finished, the vibration plate 243 of each cavity 245 is subjected to damped vibration until the subsequent ink ejecting operation is started. Hereinafter, the damped vibration may be referred to as residual vibration. It is assumed that the residual vibration of the vibration plate 243 has a natural vibration frequency that is decided by an acoustic resistance r, an inertance m, and a compliance Cm of the vibration plate 243. The acoustic resistance r depends on the shape of the nozzle N or the ink supply port 247, the viscosity of ink, or the like. The inertance m depends on the weight of ink in a flow passage.

Figure 5:
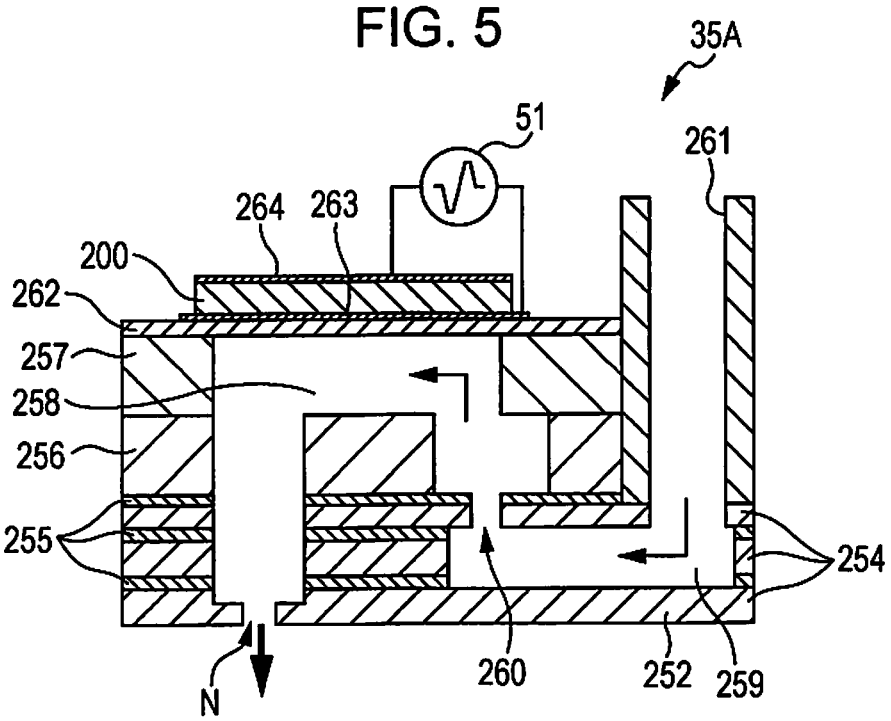
FIG. 5 is a schematic sectional view of another example of the liquid ejecting head included in the head unit.

Similarly, in the liquid ejecting head 35A illustrated in FIG. 5, when the drive signal Vin is supplied to the piezoelectric element 200 illustrated in FIG. 5 from the ejecting selection circuit 51, a distortion that is proportional to an electric field applied between the electrodes occurs. The vibration plate 262 bends in the upward direction of FIG. 5 from the initial state illustrated in FIG. 6A, and the capacity of the cavity 258 is increased as illustrated in FIG. 6B. In this state, when the voltage indicated by the drive signal Vin is changed under control of the ejecting selection circuit 51, the vibration plate 262 is restored by the elastic restoring force of the vibration plate 262 and moves in the downward direction beyond the position of the vibration plate 262 in the initial state. The capacity of the cavity 258 is rapidly decreased as illustrated in FIG. 6C. At this point, a compressive pressure that occurs in the cavity 258 causes a part of ink filling the cavity 258 to be ejected from the nozzle N communicating with the cavity 258.

After this series of ink ejecting operations is finished, the vibration plate 262 of each cavity 258 is subjected to damped vibration until the subsequent ink ejecting operation is started. Hereinafter, the damped vibration may be referred to as residual vibration. It is assumed that the residual vibration of the vibration plate 262 has a natural vibration frequency that is decided by the acoustic resistance r, the inertance m, and the compliance Cm of the vibration plate 262. The acoustic resistance r depends on the shape of the nozzle N or the ink supply port 261, the viscosity of ink, or the like. The inertance m depends on the weight of ink in a flow passage.

The liquid ejecting head 35 illustrated in FIG. 3 and the liquid ejecting head 35A illustrated in FIG. 5 eject ink based on the same principle. In addition, the residual vibration occurs after the piezoelectric element 200 is driven. Accordingly, in the following description, the liquid ejecting head 35 illustrated in FIG. 3 will be illustratively described.

1.3 Residual Vibration

Figure 7:
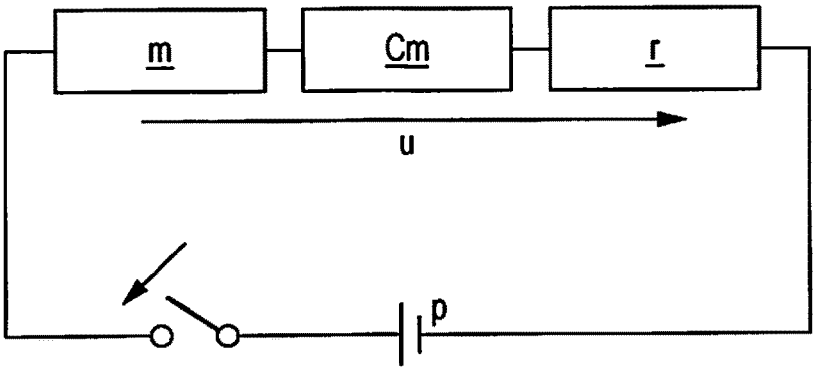
FIG. 7 is a circuit diagram illustrating a calculation model of simple harmonic vibration that assumes residual vibration of a vibration plate.

A calculation model of the residual vibration of the vibration plate 243 will be described. FIG. 7 is a circuit diagram illustrating a calculation model of simple harmonic vibration that assumes the residual vibration of the vibration plate 243. The calculation model of the residual vibration of the vibration plate 243 is represented by an acoustic pressure p, the inertance m, the compliance Cm, and the acoustic resistance r. The following expressions are obtained when a step response at the time of applying the acoustic pressure p to the circuit in FIG. 7 is calculated with respect to a volume velocity u.

$$u = \frac{p}{\omega \cdot m} e^{-\alpha \cdot t} \cdot \sin\omega t \tag{1}$$

$$\omega = \sqrt{\frac{1}{m \cdot C_m} - \alpha^2} \tag{2}$$

$$\alpha = \frac{r}{2m} \tag{3}$$

Figure 8:
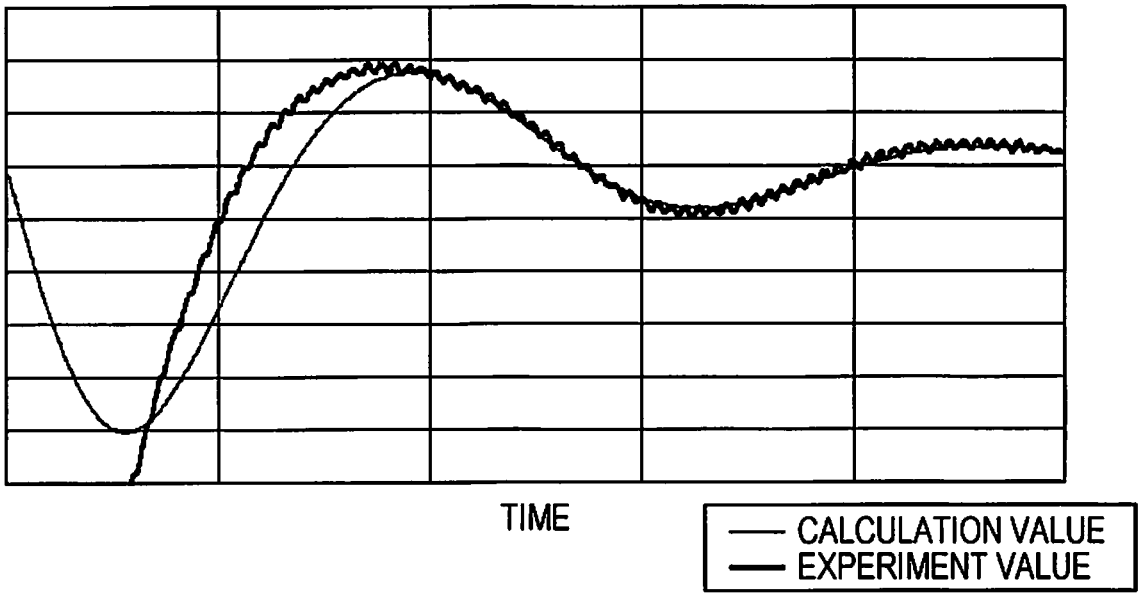
FIG. 8 is a result illustrating a relationship between an experiment value and a calculation value of the residual vibration of the vibration plate.

A calculation result obtained from the expressions is compared with an experiment result in an experiment of the residual vibration of the vibration plate 243 that is separately performed after the ejection of ink. FIG. 8 is a result illustrating a relationship between an experiment value and a calculation value of the residual vibration of the vibration plate 243. As is perceived from the result illustrated in FIG. 8, two waveforms of the experiment value and the calculation value approximately match.

A phenomenon in which ink is not normally ejected from the nozzle N even when the ejecting operation is performed, that is, the ejecting malfunction of ink, may occur in the liquid ejecting head 35. Causes of the occurrence of the ejecting malfunction are exemplified by (1) air bubble entrance in which an air bubble enters into the cavity 245, (2) dry thickening in which ink around the nozzle N dries and thickens, (3) paper dust clinging in which paper dust clings around the outlet of the nozzle N, and the like.

When the ejecting malfunction occurs, typically ink is not ejected from the nozzle N as a consequence. That is, a phenomenon of ink non-ejection occurs. In this case, pixel dot omission occurs in the image printed on the medium P. In addition, in the case of the ejecting malfunction, even when ink is ejected from the nozzle N, ink does not appropriately land due to an excessively small amount of ejected ink or deviation in flying direction of ink. Thus, the pixel dot omission occurs. Therefore, in the following description, the ejecting malfunction of ink may be simply referred to as "dot omission".

Hereinafter, the dot omission phenomenon which is the ejecting malfunction occurring in the liquid ejecting head 35 at the time of the printing process will be reviewed for each cause based on the comparison result illustrated in FIG. 8. Specifically, the value of at least one of the acoustic resistance r and the inertance m is adjusted such that the calculation value and the experiment value of the residual vibration of the vibration plate 243 approximately match, and the calculation value is compared with the experiment value.

Figure 9:
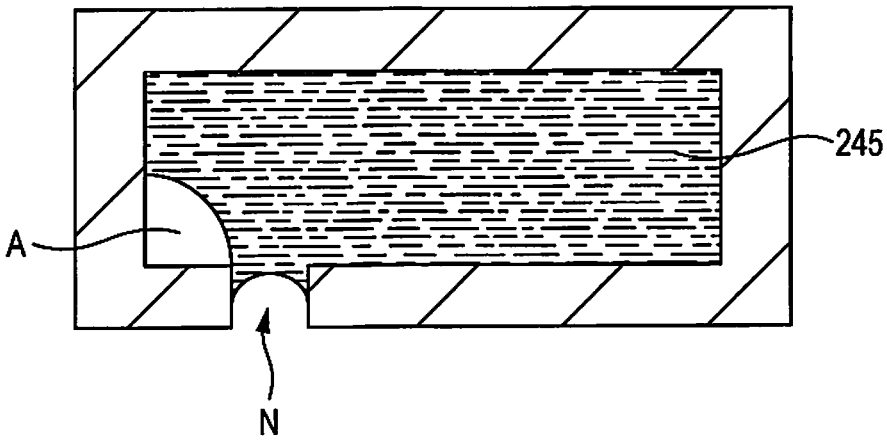
FIG. 9 is a conceptual diagram around a nozzle when air bubble entrance occurs.

First, the air bubble entrance which is one cause of the dot omission will be reviewed. FIG. 9 is a conceptual diagram around the nozzle N when the air bubble entrance occurs. As illustrated in FIG. 9, it is assumed that an air bubble A that enters occurs and clings to the wall surface of the cavity 245.

Figure 10:
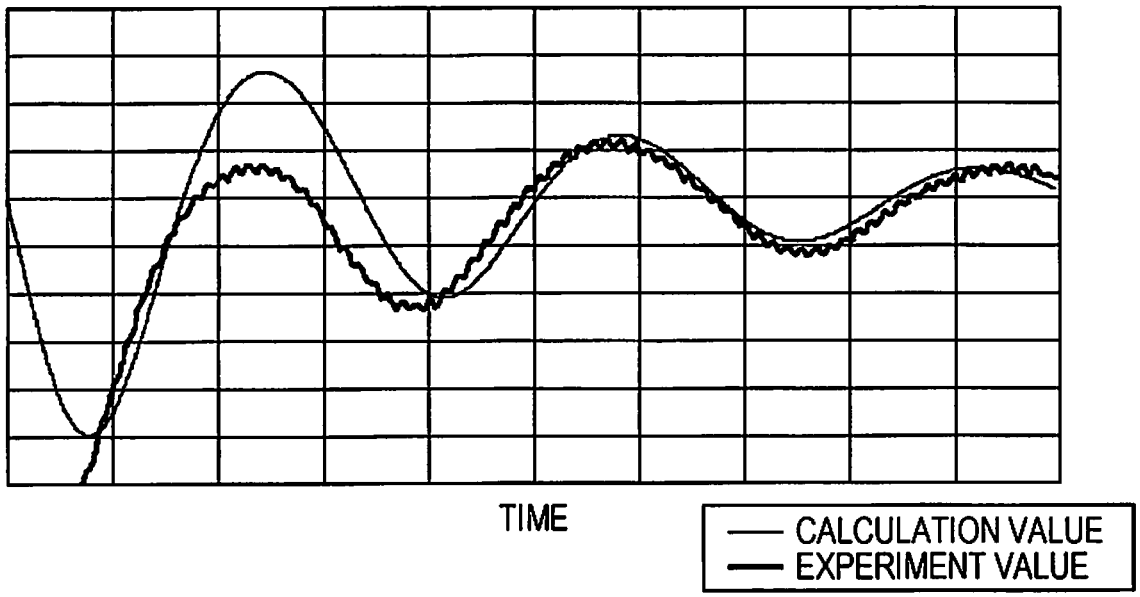
FIG. 10 is a result illustrating the relationship between the experiment value and the calculation value of the residual vibration of the vibration plate at a time of air bubble entrance.

When the air bubble A enters into the cavity 245, the total weight of ink filling the cavity 245 is decreased, and it is considered that the inertance m is decreased. In addition, as illustrated in FIG. 9, when the air bubble A clings around the nozzle N, the diameter of the nozzle N is increased by the magnitude of the diameter of the air bubble A, and it is considered that the acoustic resistance r is decreased. Accordingly, the calculation value is set to approximately match the experiment value of the residual vibration at the time of the air bubble entrance by setting both of the acoustic resistance r and the inertance m to be smaller than the acoustic resistance r and the inertance m in FIG. 8 in which ink is normally ejected. Thus, a result in FIG. 10 is obtained. FIG. 10 is a result illustrating the relationship between the experiment value and the calculation value of the residual vibration of the vibration plate 243 at the time of the air bubble entrance. As is perceived from the results in FIG. 8 and FIG. 10, when the air bubble A enters into the cavity 245, a characteristic residual vibration waveform of which the frequency is increased from the frequency of the residual vibration at the time of normal ejection is obtained. The damping ratio of the amplitude of the residual vibration is decreased due to the decrease and the like in acoustic resistance r. It can be also confirmed that the amplitude of the residual vibration is slowly decreased.

Figure 11:
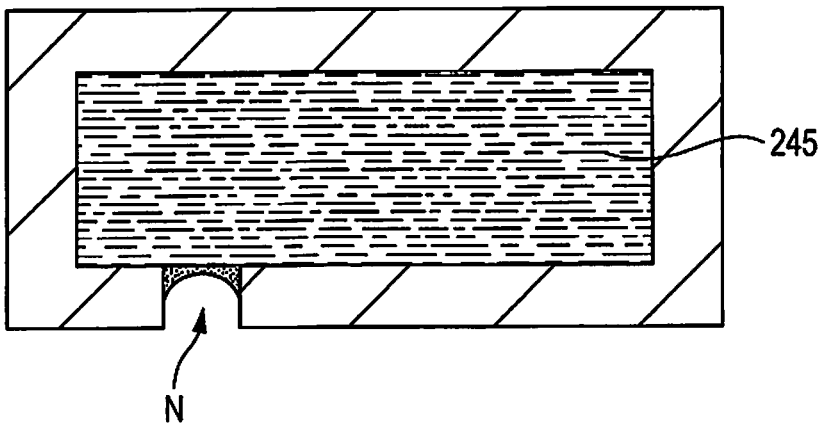
FIG. 11 is a conceptual diagram around the nozzle at a time of dry thickening.

Next, the dry thickening which is one cause of the dot omission will be reviewed. FIG. 11 is a conceptual diagram around the nozzle N at the time of the dry thickening. As illustrated in FIG. 11, when ink around the nozzle N dries and solidifies, ink in the cavity 245 is confined in the cavity 245. When ink around the nozzle N dries and thickens, it is considered that the acoustic resistance r is increased.

Figure 12:
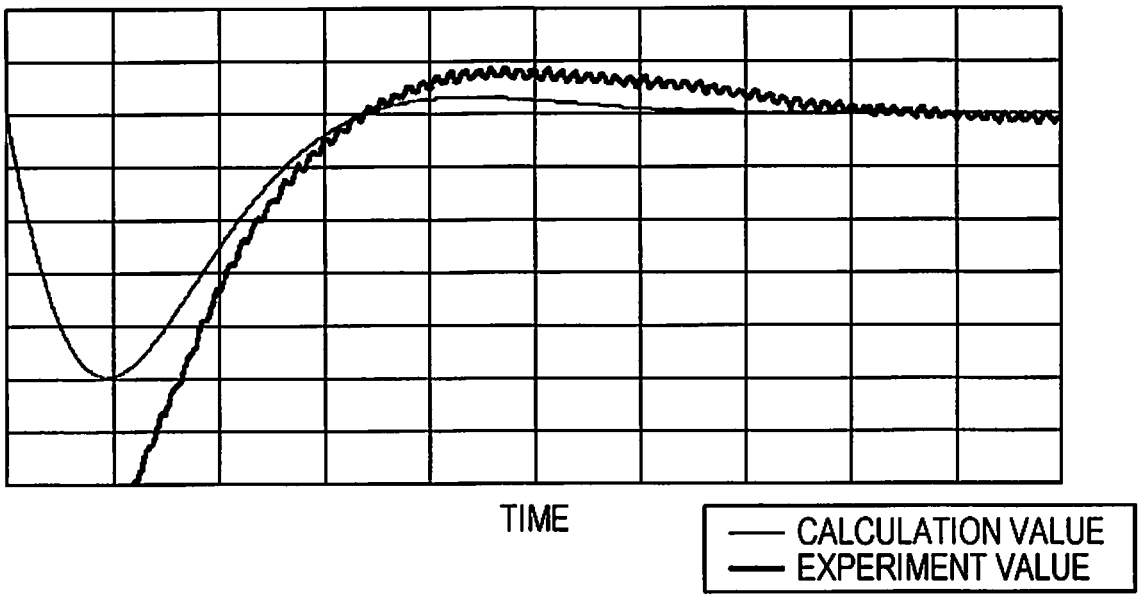
FIG. 12 is a result illustrating the relationship between the experiment value and the calculation value of the residual vibration of the vibration plate at the time of dry thickening.

Accordingly, the calculation value is set to approximately match the experiment value of the residual vibration at the time of the dry thickening of ink around the nozzle N by setting the acoustic resistance r to be greater than the acoustic resistance r in FIG. 8 in which ink is normally ejected. Thus, a result in FIG. 12 is obtained. FIG. 12 is a result illustrating the relationship between the experiment value and the calculation value of the residual vibration of the vibration plate 243 at the time of the dry thickening. The experiment value illustrated in FIG. 12 is obtained by measuring the residual vibration of the vibration plate 243 in a state in which the liquid ejecting head 35 is left for a few days without mounting the cap, not illustrated, and ink cannot be ejected due to solidification of ink caused by drying and thickening of ink around the nozzle N. As is perceived from the results in FIG. 8 and FIG. 12, when ink around the nozzle N dries and solidifies, the frequency of the residual vibration is significantly decreased from the frequency of the residual vibration at the time of normal ejection, and a characteristic residual vibration waveform in which the residual vibration is overdamped is obtained. The reason is that the vibration plate 243 that is drawn in the upward direction of FIG. 3 in order to eject ink causes ink to flow into the cavity 245 from the reservoir 246, and then, ink in the cavity 245 does not escape when the vibration plate 243 moves in the downward direction of FIG. 3. Thus, the vibration plate 243 cannot rapidly vibrate.

Figure 13:
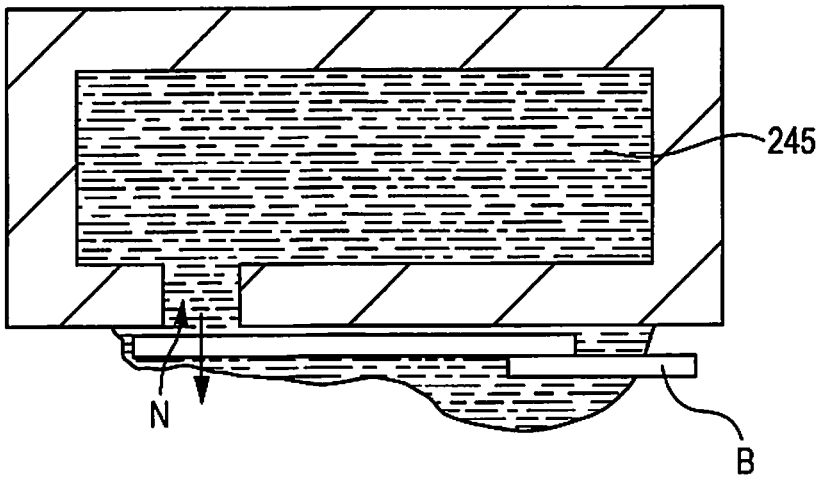
FIG. 13 is a conceptual diagram around the nozzle at a time of paper dust clinging.

Next, the paper dust clinging which is one cause of the dot omission will be reviewed. FIG. 13 is a conceptual diagram around the nozzle N at the time of the paper dust clinging. As illustrated in FIG. 13, when paper dust B clings around the outlet of the nozzle N, ink oozes from the cavity 245 through the paper dust B, and ink cannot be ejected from the nozzle N. When the paper dust B clings around the outlet of the nozzle N, and ink oozes from the nozzle N, the amount of ink including the ink in the cavity 245 and the oozing ink when seen from the vibration plate 243 is increased from the normal amount of ink. Thus, it is considered that the inertance m is increased. In addition, it is considered that the acoustic resistance r is increased due to fibers of the paper dust B clinging around the outlet of the nozzle N.

Figure 14:
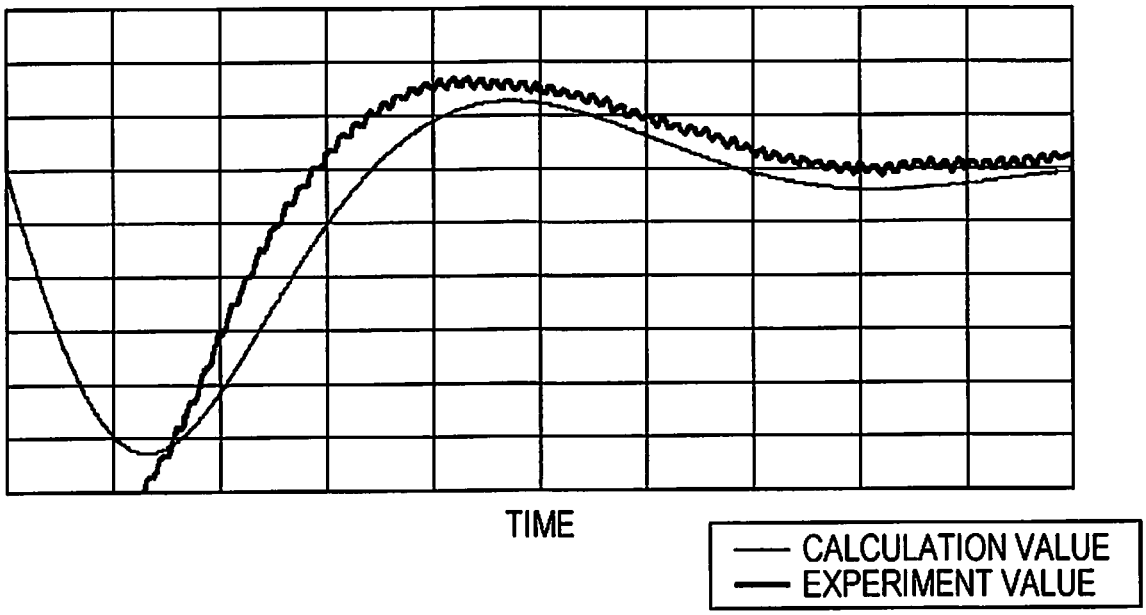
FIG. 14 is a result illustrating the relationship between the experiment value and the calculation value of the residual vibration of the vibration plate at the time of paper dust clinging.

Accordingly, the calculation value is set to approximately match the experiment value of the residual vibration at the time of the paper dust clinging around the outlet of the nozzle N by setting both of the inertance m and the acoustic resistance r to be greater than the inertance m and the acoustic resistance r in FIG. 8 in which ink is normally ejected. Thus, a result in FIG. 14 is obtained. FIG. 14 is a result illustrating the relationship between the experiment value and the calculation value of the residual vibration of the vibration plate 243 at the time of the paper dust clinging. As is perceived from the results in FIG. 8 and FIG. 14, when the paper dust B clings around the outlet of the nozzle N, a characteristic residual vibration waveform of which the frequency is decreased from the frequency of the residual vibration at the time of normal ejection is obtained.

From the results illustrated in FIG. 12 and FIG. 14, it is perceived that in the case of the paper dust clinging, the frequency of the residual vibration is higher than the frequency of the residual vibration in the case of the dry thickening of ink.

Either when ink around the nozzle N dries and thickens or when paper dust clings around the outlet of the nozzle N, the frequency of the damped vibration is decreased from the frequency of the damped vibration when an ink drop is normally ejected. In order to specify these two causes of the dot omission from the waveform of the residual vibration of the vibration plate 243, for example, the frequency, the cycle, and the phase of the damped vibration are compared with predetermined thresholds. Alternatively, the two causes of the dot omission can be specified from the damping ratio of a change in cycle or a change in amplitude of the residual vibration. The ejecting malfunction of each liquid ejecting head 35 can be detected depending on a change in residual vibration of the vibration plate 243, particularly, a change in frequency, from a time when the ink drop is ejected from the nozzle N in each liquid ejecting head 35. In addition, in that case, the cause of the ejecting malfunction can be specified by comparing the frequency of the residual vibration with the frequency of the residual vibration at the time of normal ejection.

The liquid ejecting apparatus 1 according to the present embodiment executes an ejecting malfunction detection process of detecting the ejecting malfunction by analyzing the residual vibration in the ejecting malfunction detection circuit 52.

1.4 Configuration and Operation of Ejecting Selection Circuit

Figure 15:
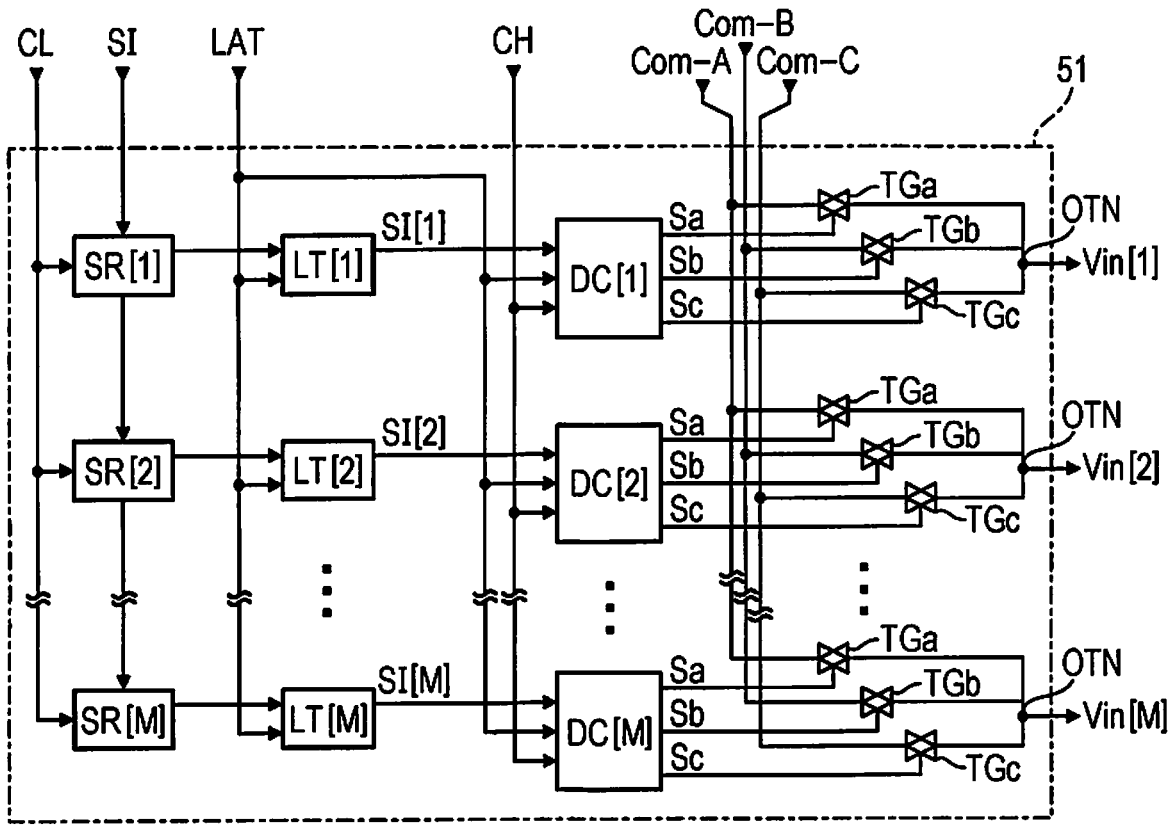
FIG. 15 is a block diagram illustrating a configuration of an ejecting selection circuit.

Next, a configuration and an operation of the ejecting selection circuit 51 will be described using FIG. 15 to FIG. 18. FIG. 15 is a block diagram illustrating the configuration of the ejecting selection circuit 51. As illustrated in FIG. 15, the ejecting selection circuit 51 includes M sets of a shift register SR, a latch circuit LT, a decoder DC, and transmission gates TGa, TGb, and TGc in one-to-one correspondence with M liquid ejecting heads 35. Hereinafter, each element constituting the M sets may be referred to as a first stage, a second stage, . . . , and an M-th stage in this order from the top of FIG. 15. In FIG. 15, the shift registers SR corresponding to the first stage, the second stage, . . . , and the M-th stage are denoted by SR[1], SR[2], . . . , and SR[M]. The latch circuits LT corresponding to the first stage, the second stage, . . . , and the M-th stage are denoted by LT[1], LT[2], . . . , and LT[M]. The decoders DC corresponding to the first stage, the second stage, . . . , and the M-th stage are denoted by DC[1], DC[2], . . . , and DC[M].

The ejecting selection circuit 51 is supplied with the clock signal CL, the printing signal SI, the latch signal LAT, the change signal CH, and the drive waveform signal Com (Com-A, Com-B, and Com-C).

The printing signal SI is a digital signal that defines the amount of ink to be ejected from the nozzle N included in each liquid ejecting head 35 for forming one dot of the image. More specifically, the printing signal SI according to the present embodiment defines the amount of ink to be ejected from the nozzle N corresponding to each liquid ejecting head 35 in three bits of a high order bit b1, a middle order bit b2, and a low order bit b3. The printing signal SI is serially supplied to the ejecting selection circuit 51 from the control unit 6 in synchronization with the clock signal CL. By controlling the amount of ink to be ejected from each liquid ejecting head 35 using the printing signal SI, four gradations of no recording, a small dot, a medium dot, and a large dot can be represented for each dot on the medium P. Furthermore, the drive signal Vin for test that is used for testing the ejecting state of ink can be generated by causing the residual vibration.

Each shift register SR temporarily holds the printing signal SI in three bits corresponding to each liquid ejecting head 35. Specifically, the M shift registers SR of the first stage, the second stage, . . . , and the M-th stage that correspond one-to-one to the M liquid ejecting heads 35 are coupled in a cascade. The printing signal SI that is serially supplied is sequentially transferred to the subsequent stages in accordance with the clock signal CL. When the printing signal SI is transferred to all of the M shift registers SR, the supply of the clock signal CL stops, and a state in which each of the M shift registers SR holds data of corresponding three bits of the printing signal SI is maintained.

Each of the M latch circuits LT simultaneously latches, at a timing at which the latch signal LAT rises, the printing signal SI of three bits that correspond to each stage and that are held in each of the M shift registers SR. In FIG. 15, each of SI[1], SI[2], . . . , and SI[M] represents the printing signal SI of three bits that are latched by each of the latch circuits LT[1], LT[2], . . . , and LT[M] corresponding to the shift registers SR of the first stage, the second stage, . . . , and the M-th stage.

An operation period that is a period in which the liquid ejecting apparatus 1 executes printing includes a plurality of unit operation periods Tu. Each unit operation period Tu includes a control period Ts1 and a subsequent control period Ts2. In the present embodiment, the control periods Ts1 and Ts2 have the same length of time.

The plurality of unit operation periods Tu constituting the operation period includes the unit operation period Tu in which the printing process is executed, the unit operation period Tu in which the ejecting malfunction detection process is executed, and the unit operation period Tu in which the processes of both of the printing process and the ejecting malfunction detection process are executed.

The control unit 6 supplies the printing signal SI to the ejecting selection circuit 51 for each unit operation period Tu and controls the ejecting selection circuit 51 such that the latch circuits LT latch the printing signals SI[1], SI[2], . . . , and SI[M] for each unit operation period Tu. That is, the control unit 6 controls the ejecting selection circuit 51 such that the drive signal Vin is supplied to the M liquid ejecting heads 35 for each unit operation period Tu.

More specifically, when only the printing process is executed in the unit operation period Tu, the control unit 6 controls the ejecting selection circuit 51 such that the drive signal Vin for printing is supplied to the M liquid ejecting heads 35. Accordingly, the M liquid ejecting heads 35 eject the amount of ink corresponding to the image data Img to the medium P, and an image corresponding to the image data Img is formed on the medium P.

When only the ejecting malfunction detection process is executed in the unit operation period Tu, the control unit 6 controls the ejecting selection circuit 51 such that the drive signal Vin for test is supplied to the M liquid ejecting heads 35.

When both of the printing process and the ejecting malfunction detection process are executed in the unit operation period Tu, the control unit 6 controls the ejecting selection circuit 51 such that the drive signal Vin for printing is supplied to a part of the M liquid ejecting heads 35, and the drive signal Vin for test is supplied to the remaining liquid ejecting heads 35.

Each decoder DC decodes the printing signal SI of three bits latched by each latch circuit LT and outputs selection signals Sa, Sb, and Sc in each of the control periods Ts1 and Ts2.

FIG. 16 is a diagram illustrating the content of decoding performed by the decoders DC. As illustrated in FIG. 16, for example, when the content of the printing signal SI[m] corresponding to the m-th stage (m is a natural number satisfying $1 \leq m \leq 5$ M) is (b1, b2, b3)=(1, 0, 0), the decoder DC of the m-th stage sets the selection signal Sa to a high level H and sets the selection signals Sb and Sc to a low level L in the control period Ts1. In addition, the decoder DC of the m-th stage sets the selection signals Sa and Sc to the low level L and sets the selection signal Sb to the high level H in the control period Ts2.

When the low order bit b3 is "1", that is, (b1, b2, b3)=(0, 0, 1), the decoder DC of the m-th stage sets the selection signals Sa and Sb to the low level L and sets the selection signal Sc to the high level H in the control periods Ts1 and Ts2.

FIG. 15 will be described again. As illustrated in FIG. 15, the ejecting selection circuit 51 includes M sets of the transmission gates TGa, TGb, and TGc. The M sets of the transmission gates TGa, TGb, and TGc are disposed in one-to-one correspondence with the M liquid ejecting heads 35.

The transmission gate TGa is switched ON when the selection signal Sa is at the level H, and is switched OFF when the selection signal Sa is at the level L. The transmission gate TGb is switched ON when the selection signal Sb is at the level H, and is switched OFF when the selection signal Sb is at the level L. The transmission gate TGc is switched ON when the selection signal Sc is at the level H, and is switched OFF when the selection signal Sc is at the level L.

For example, in the m-th stage, when the content of the printing signal SI[m] is (b1, b2, b3)=(1, 0, 0), the transmission gate TGa is switched ON, and the transmission gates TGb and TGc are switched OFF in the control period Ts1. In the control period Ts2, the transmission gate TGb is switched ON, and the transmission gates TGb and TGc are switched OFF.

The drive waveform signal Com-A is supplied to one end of the transmission gate TGa. The drive waveform signal Com-B is supplied to one end of the transmission gate TGb. The drive waveform signal Com-C is supplied to one end of the transmission gate TGc. The other ends of the transmission gates TGa, TGb, and TGc are coupled in common to an output terminal OTN that leads to the switching circuit 53.

The transmission gates TGa, TGb, and TGc are exclusively switched ON. The drive waveform signals Com-A, Com-B, and Com-C selected in each of the control periods Ts1 and Ts2 are output to the output terminal OTN as the drive signal Vin[m]. The drive signal Vin[m] is supplied to the liquid ejecting head 35 of the m-th stage through the switching circuit 53.

Figure 17:
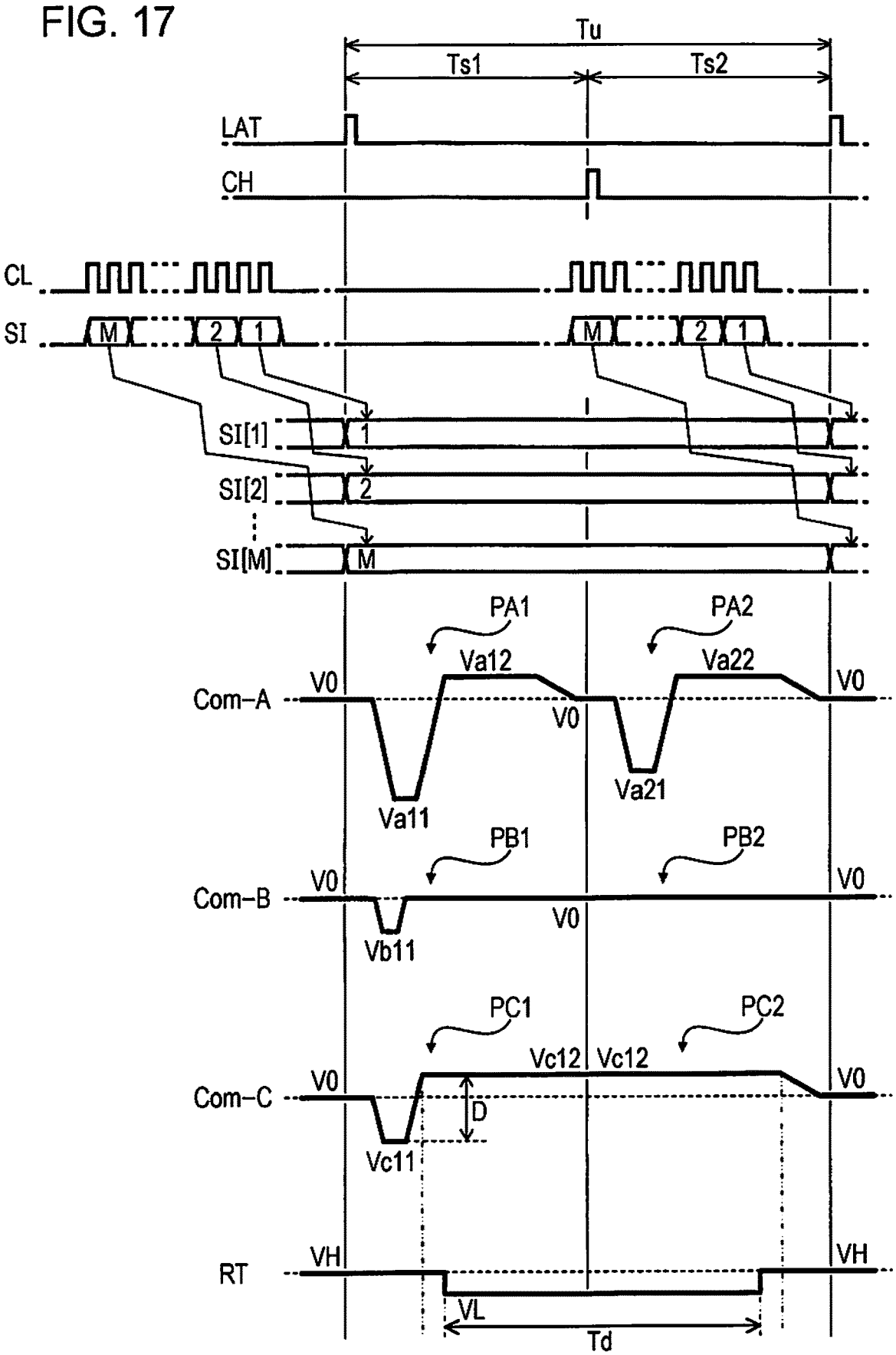
FIG. 17 is a timing chart for describing an operation of the ejecting selection circuit in a unit operation period.

FIG. 17 is a timing chart for describing the operation of the ejecting selection circuit 51 in the unit operation period Tu. As illustrated in FIG. 17, the unit operation period Tu is defined by the latch signal LAT output by the control unit 6. The control periods Ts1 and Ts2 included in the unit operation period Tu are defined by the latch signal LAT and the change signal CH output by the control unit 6.

The drive waveform signal Com-A supplied from the drive signal generation circuit 54 in the unit operation period Tu is a signal for generating the drive signal Vin for printing. As illustrated in FIG. 17, the drive waveform signal Com-A has a waveform in which a unit waveform PA1 arranged in the control period Ts1 of the unit operation period Tu and a unit waveform PA2 arranged in the control period Ts2 are consecutively set. The potential at any of the start and end timings of the unit waveform PA1 and the unit waveform PA2 is a reference potential V0. The difference in potential between a potential Va11 and a potential Va12 of the unit waveform PA1 is greater than the difference in potential between a potential Va21 and a potential Va22 of the unit waveform PA2. Thus, when the piezoelectric elements 200 included in each liquid ejecting head 35 are driven by the unit waveform PA1, the amount of ink ejected from the nozzle N included in the liquid ejecting head 35 is greater than the amount of ink ejected when the piezoelectric elements 200 are driven by the unit waveform PA2.

The drive waveform signal Com-B supplied from the drive signal generation circuit 54 in the unit operation period Tu is a signal for generating the drive signal Vin for printing. The drive waveform signal Com-B has a waveform in which a unit waveform PB1 arranged in the control period Ts1 and a unit waveform PB2 arranged in the control period Ts2 are consecutively set. The potential at any of the start and end timings of the unit waveform PB1 is the reference potential V0. The unit waveform PB2 is maintained at the reference potential V0 throughout the control period Ts2. The difference in potential between a potential Vb11 of the unit waveform PB1 and the reference potential V0 is smaller than the difference in potential between the potential Va21 and the potential Va22 of the unit waveform PA2. Even when the piezoelectric elements 200 included in each liquid ejecting head 35 are driven by the unit waveform PB1, ink is not ejected from the nozzle N included in the liquid ejecting head 35. Similarly, even when the unit waveform PB2 is supplied to the piezoelectric elements 200, ink is not ejected from the nozzle N.

The drive waveform signal Com-C supplied from the drive signal generation circuit 54 in the unit operation period Tu is a signal for generating the drive signal Vin for test. The drive waveform signal Com-C has a waveform in which a unit waveform PC1 arranged in the control period Ts1 and a unit waveform PC2 arranged in the control period Ts2 are consecutively set. Any of the potential at the start timing of the unit waveform PC1 and the potential at the end timing of the unit waveform PC2 is the reference potential V0. The unit waveform PC1 transitions to a potential Vc11 from the reference potential V0, then transitions to a potential Vc12 from the potential Vc11, and then is maintained at the potential Vc12 until the end of the control period Ts1. The unit waveform PC2 is maintained at the potential Vc12 and then, transitions to the reference potential V0 from the potential Vc12 before the end of the control period Ts2. A drive voltage D that is the difference in potential between the potential Vc11 and the potential Vc12 is set to a voltage at which ink is not ejected from the nozzle N included in the liquid ejecting head 35 even when the piezoelectric elements 200 included in the liquid ejecting head 35 are driven by the unit waveforms PC1 and PC2.

As illustrated in FIG. 17, the M latch circuits LT output the printing signals SI[1], SI[2], . . . , and SI[M] at a timing at which the latch signal LAT rises, that is, at a timing at which the unit operation period Tu is started.

As described above, the decoder DC of the m-th stage outputs, depending on the printing signal SI[m], the selection signals Sa, Sb, and Sc in each of the control periods Ts1 and Ts2 based on the content of decoding illustrated in FIG. 16.

As described above, the transmission gates TGa, TGb, and TGc of the m-th stage select and output any one of the drive waveform signals Com-A, Com-B, and Com-C as the drive signal Vin[m] based on the selection signals Sa, Sb, and Sc.

A switching period designation signal RT illustrated in FIG. 17 is a signal that defines a switching period Td. The switching period designation signal RT and the switching period Td will be described below.

The waveform of the drive signal Vin output from the ejecting selection circuit 51 in the unit operation period Tu will be described with reference to FIG. 15 to FIG. 17 and FIG. 18.

Figure 18:
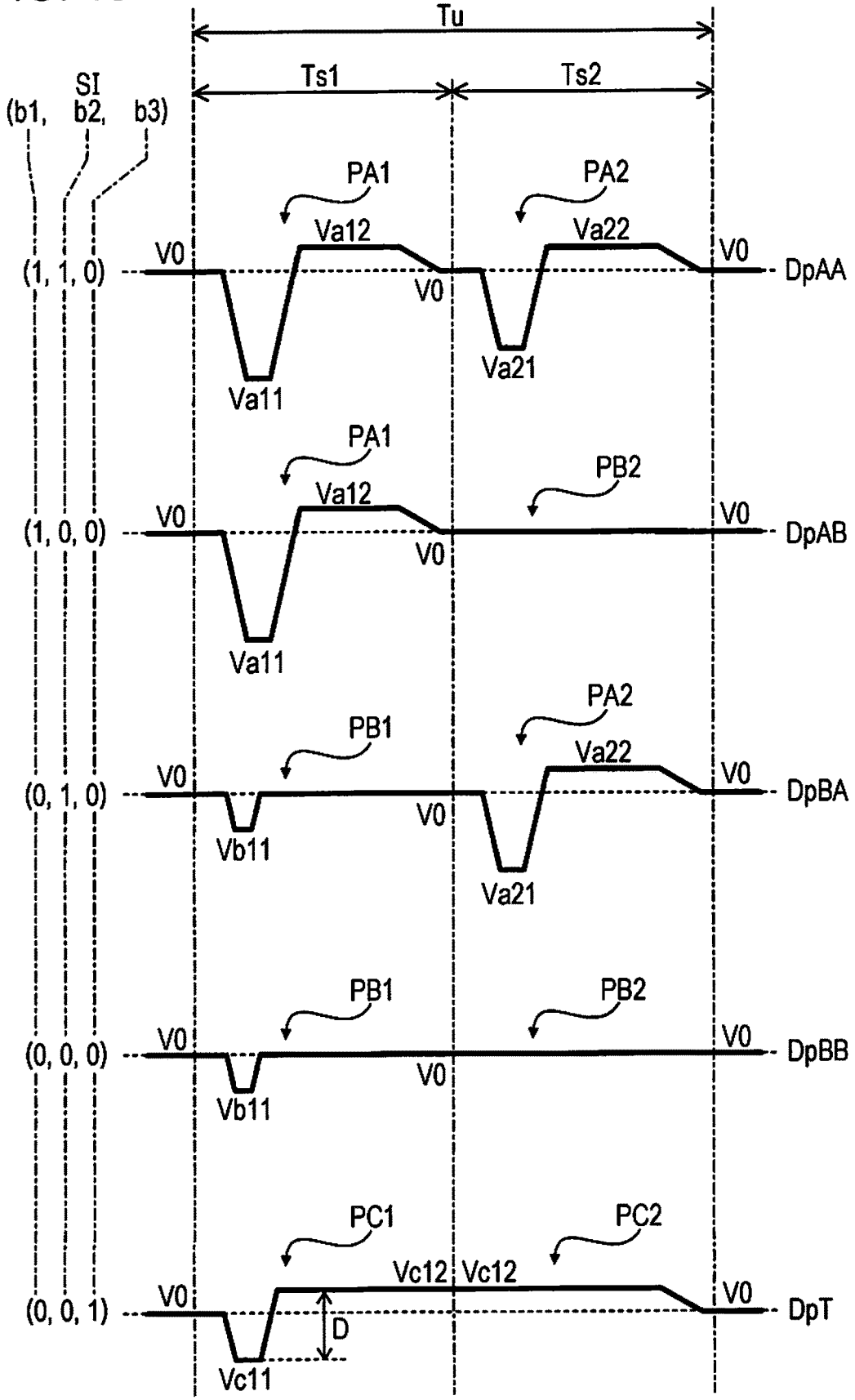
FIG. 18 is a diagram illustrating one example of a waveform of a drive signal.

FIG. 18 is a diagram illustrating one example of the waveform of the drive signal Vin. When the content of the printing signal SI[m] supplied in the unit operation period Tu is (b1, b2, b3)=(1, 1, 0), the selection signals Sa, Sb, and Sc are set to the levels H, L, and L, respectively in the control period Ts1. Thus, the drive waveform signal Com-A is selected by the transmission gate TGa, and the unit waveform PA1 is output as the drive signal Vin[m]. In the control period Ts2, the drive waveform signal Com-A is selected by the transmission gate TGa, and the unit waveform PA2 is output as the drive signal Vin[m] in the same manner as in the control period Ts1. That is, when the content of the printing signal SI[m] is (b1, b2, b3)=(1, 1, 0), the drive signal Vin[m] supplied to the liquid ejecting head 35 of the m-th stage in the unit operation period Tu is the drive signal Vin for printing, and the waveform of the drive signal Vin is a waveform DpAA that includes the unit waveform PA1 and the unit waveform PA2 as illustrated in FIG. 18. Consequently, in the unit operation period Tu, the liquid ejecting head 35 of the m-th stage ejects approximately a medium amount of ink based on the unit waveform PA1 and approximately a small amount of ink based on the unit waveform PA2. The ink ejected twice is combined on the medium P. Thus, the large dot is formed on the medium P.

When the content of the printing signal SI[m] supplied in the unit operation period Tu is (b1, b2, b3)=(1, 0, 0), the selection signals Sa, Sb, and Sc are set to the levels H, L, and L, respectively in the control period Ts1. Thus, the drive waveform signal Com-A is selected by the transmission gate TGa, and the unit waveform PA1 is output as the drive signal Vin[m]. In the control period Ts2, the selection signals Sa, Sb, and Sc are set to the levels L, H, and L, respectively. Thus, the drive waveform signal Com-B is selected by the transmission gate TGb, and the unit waveform PB2 is output as the drive signal Vin[m]. That is, when the content of the printing signal SI[m] is (b1, b2, b3)=(1, 0, 0), the drive signal Vin[m] supplied to the liquid ejecting head 35 of the m-th stage in the unit operation period Tu is the drive signal Vin for printing, and the waveform of the drive signal Vin is a waveform DpAB that includes the unit waveform PA1 and the unit waveform PB2 as illustrated in FIG. 18. Consequently, in the unit operation period Tu, the liquid ejecting head 35 of the m-th stage ejects approximately a medium amount of ink based on the unit waveform PA1, and the medium dot is formed on the medium P.

When the content of the printing signal SI[m] supplied in the unit operation period Tu is (b1, b2, b3)=(0, 1, 0), the selection signals Sa, Sb, and Sc are set to the levels L, H, and L, respectively in the control period Ts1. Thus, the drive waveform signal Com-B is selected by the transmission gate TGb, and the unit waveform PB1 is output as the drive signal Vin[m]. In the control period Ts2, the selection signals Sa, Sb, and Sc are set to the levels H, L, and L, respectively. Thus, the drive waveform signal Com-A is selected by the transmission gate TGa, and the unit waveform PA2 is output as the drive signal Vin[m]. That is, when the content of the printing signal SI[m] is (b1, b2, b3)=(0, 1, 0), the drive signal Vin[m] supplied to the liquid ejecting head 35 of the m-th stage in the unit operation period Tu is the drive signal Vin for printing, and the waveform of the drive signal Vin is a waveform DpBA that includes the unit waveform PB1 and the unit waveform PA2 as illustrated in FIG. 18. Consequently, in the unit operation period Tu, the liquid ejecting head 35 of the m-th stage ejects approximately a small amount of ink based on the unit waveform PA2, and the small dot is formed on the medium P.

When the content of the printing signal SI[m] supplied in the unit operation period Tu is (b1, b2, b3)=(0, 0, 0), the selection signals Sa, Sb, and Sc are set to the levels L, H, and L, respectively in the control period Ts1. Thus, the drive waveform signal Com-B is selected by the transmission gate TGb, and the unit waveform PB1 is output as the drive signal Vin[m]. In the control period Ts2, the drive waveform signal Com-B is selected by the transmission gate TGb, and the unit waveform PB2 is output as the drive signal Vin[m] in the same manner as in the control period Ts1. That is, when the content of the printing signal SI[m] is (b1, b2, b3)=(0, 0, 0), the drive signal Vin[m] supplied to the liquid ejecting head 35 of the m-th stage in the unit operation period Tu is the drive signal Vin for printing, and the waveform of the drive signal Vin is a waveform DpBB that includes the unit waveform PB1 and the unit waveform PB2 as illustrated in FIG. 18. Consequently, in the unit operation period Tu, ink is not ejected from the liquid ejecting head 35 of the m-th stage, and a dot is not formed on the medium P.

When the content of the printing signal SI[m] supplied in the unit operation period Tu is (b1, b2, b3)=(0, 0, 1), the selection signals Sa, Sb, and Sc are set to the levels L, L, and H, respectively in the control period Ts1. Thus, the drive waveform signal Com-C is selected by the transmission gate TGc, and the unit waveform PC1 is output as the drive signal Vin[m]. In the control period Ts2, the drive waveform signal Com-C is selected by the transmission gate TGc, and the unit waveform PC2 is output as the drive signal Vin[m] in the same manner as in the control period Ts1. That is, when the content of the printing signal SI[m] is (b1, b2, b3)=(0, 0, 1), the drive signal Vin[m] supplied to the liquid ejecting head 35 of the m-th stage in the unit operation period Tu is the drive signal Vin for test, and the waveform of the drive signal Vin is a waveform DpT that includes the unit waveform PC1 and the unit waveform PC2 as illustrated in FIG. 18. The waveform DpT is set to a waveform in which ink is not ejected from the liquid ejecting head 35 even when the drive signal Vin having the waveform DpT is supplied to the liquid ejecting head 35 in a test waveform decision process.

1.5 Operation of Switching Circuit

Figure 19:
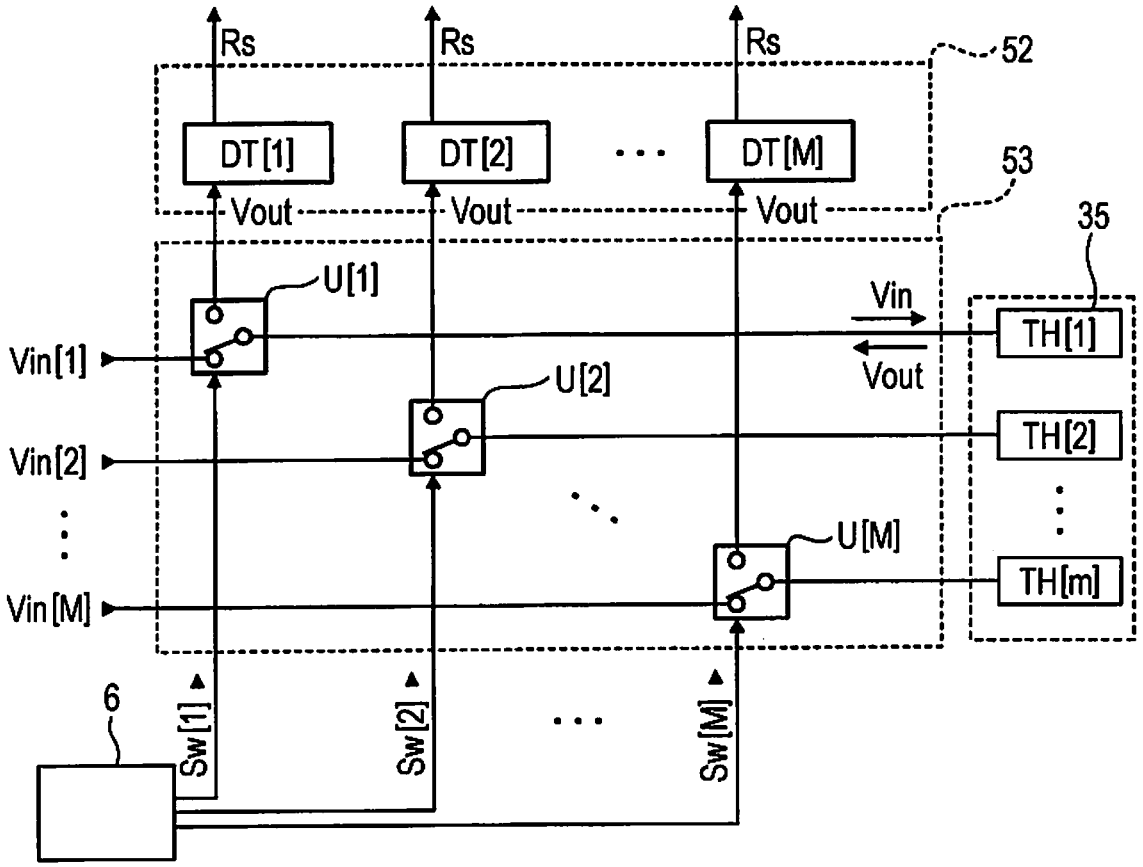
FIG. 19 is a block diagram illustrating a configuration of a switching circuit and an electrical coupling relationship among the switching circuit, an ejecting malfunction detection circuit, the head unit, and the ejecting selection circuit.

FIG. 19 is a block diagram illustrating a configuration of the switching circuit 53 and an electrical coupling relationship among the switching circuit 53, the ejecting malfunction detection circuit 52, the head unit 30, and the ejecting selection circuit 51.

As illustrated in FIG. 19, the switching circuit 53 includes M switching circuits U of the first stage to the M-th stage that correspond one-to-one to the M liquid ejecting heads 35. The ejecting malfunction detection circuit 52 includes M ejecting malfunction detection circuits DT of the first stage to the M-th stage that correspond one-to-one to the M liquid ejecting heads 35. In FIG. 19, the switching circuits U corresponding to the first stage, the second stage, . . . , and the M-th stage are denoted by U[1], U[2], . . . , and U[M]. The ejecting malfunction detection circuits 52 corresponding to the first stage, the second stage, . . . , and the M-th stage are denoted by DT[1], DT[2], . . . , and DT[M]. The liquid ejecting heads 35 corresponding to the first stage, the second stage, . . . , and the M-th stage are denoted by TH[1], TH[2], . . . , and TH[M]. The switching circuit U[m] of the m-th stage electrically couples the piezoelectric elements 200 of the liquid ejecting head TH[m] of the m-th stage to any one of the output terminal OTN of the m-th stage included in the ejecting selection circuit 51 or the ejecting malfunction detection circuit DT[m] of the m-th stage included in the ejecting malfunction detection circuit 52.

That is, in the liquid ejecting apparatus 1 of the present embodiment, the ejecting malfunction detection circuit DT[p] (p is any of 1 to M) detects the presence or absence of the ejecting malfunction of the nozzle N included in the liquid ejecting head TH[p] and specifies the cause of the ejecting malfunction. The switching circuit U[p] switches between electrically coupling the liquid ejecting head TH[p] to the ejecting selection circuit 51 and electrically coupling the liquid ejecting head TH[p] to the ejecting malfunction detection circuit DT[p]. The ejecting malfunction detection circuit DT[q] (q is any of 1 to M, and p≠q) detects the presence or absence of the ejecting malfunction of the nozzle N included in the liquid ejecting head TH[q] and specifies the cause of the ejecting malfunction. The switching circuit U[q] switches between electrically coupling the liquid ejecting head TH[q] to the ejecting selection circuit 51 and electrically coupling the liquid ejecting head TH[q] to the ejecting malfunction detection circuit DT[q].

In this case, the ejecting selection circuit 51 selects whether or not to supply the drive waveform signal Com to the piezoelectric elements 200 included in the liquid ejecting head TH[p] and the piezoelectric elements 200 included in the liquid ejecting head TH[q].

When both of the switching circuit U[p] and the switching circuit U[q] execute the ejecting malfunction detection process, the detection of the presence or absence of the ejecting malfunction of the nozzle N included in the liquid ejecting head TH[p] and the specifying of the cause of the ejecting malfunction in the ejecting malfunction detection circuit DT[p] are executed in parallel with the detection of the presence or absence of the ejecting malfunction of the nozzle N included in the liquid ejecting head TH[q] and the specifying of the cause of the ejecting malfunction in the ejecting malfunction detection circuit DT[q]. Accordingly, even when the plurality of liquid ejecting heads 35 are provided, the detection of the presence or absence of the ejecting malfunction of the corresponding nozzle N and the specifying of the cause of the ejecting malfunction can be executed in a short time period.

When the ejecting malfunction occurs in the nozzle N included in each of the ejecting malfunction detection circuit DT[p] and the ejecting malfunction detection circuit DT[q], the recovery mechanism 84 is notified of the occurrence of the ejecting malfunction in each of the ejecting malfunction detection circuit DT[p] and the ejecting malfunction detection circuit DT[q] through the control unit 6. The recovery mechanism 84 executes the recovery process on the liquid ejecting head TH[p] depending on the cause of the ejecting malfunction detected by the ejecting malfunction detection circuit DT[p], and executes the recovery process on the liquid ejecting head TH[q] depending on the cause of the ejecting malfunction detected by the ejecting malfunction detection circuit DT[q].

The ejecting malfunction detection circuit DT[p] is one example of a first ejecting malfunction detection circuit. The liquid ejecting head TH[p] is one example of a first liquid ejecting head. The switching circuit U[p] is one example of a first switching circuit. The ejecting malfunction detection circuit DT[q] is one example of a second ejecting malfunction detection circuit. The liquid ejecting head TH[q] is one example of a second liquid ejecting head. The switching circuit U[q] is one example of a second switching circuit. In each switching circuit U, a state in which the liquid ejecting head 35 is electrically coupled to the output terminal OTN of the ejecting selection circuit 51 is referred to as a first coupling state. A state in which the liquid ejecting head 35 is electrically coupled to the ejecting malfunction detection circuit DT of the ejecting malfunction detection circuit 52 is referred to as a second coupling state.

The control unit 6 outputs, to each switching circuit U, the switching control signal Sw for controlling the coupling state of each switching circuit U.

Specifically, when the liquid ejecting head 35 of the m-th stage is used in the printing process in the unit operation period Tu, the control unit 6 supplies, to the switching circuit U[m], the switching control signal Sw[m] that causes the switching circuit U[m] corresponding to the liquid ejecting head 35 of the m-th stage to maintain the first coupling state throughout the whole period of the unit operation period Tu.

When the liquid ejecting head 35 of the m-th stage is set as a target of the ejecting malfunction detection process or a target of the test waveform decision process in the unit operation period Tu, the control unit 6 supplies, to the switching circuit U[m], the switching control signal Sw[m] that causes the switching circuit U[m] corresponding to the liquid ejecting head 35 of the m-th stage to enter the first coupling state in a period of the unit operation period Tu other than the switching period Td and to enter the second coupling state in the switching period Td of the unit operation period Tu. Thus, in the period of the unit operation period Tu other than the switching period Td, the drive signal Vin is supplied to the liquid ejecting head 35 as the target of the ejecting malfunction detection process from the ejecting selection circuit 51. In the switching period Td of the unit operation period Tu, the residual vibration signal Vout is supplied to the ejecting malfunction detection circuit DT from the liquid ejecting head 35.

As illustrated in FIG. 17, the switching period Td is a period in which the switching period designation signal RT generated by the control unit 6 is set to a potential VL. Specifically, the switching period Td is a period that is set as a part or the whole of a period of the unit operation period Tu in which the drive waveform signal Com-C is maintained at the potential Vc12.

The ejecting malfunction detection circuit DT detects, as the residual vibration signal Vout, a change in electromotive force, in the switching period Td, of the piezoelectric elements 200 of the liquid ejecting head 35 to which the drive signal Vin for test is supplied.

The configuration thus far enables the switching circuit U[i] of the i-th stage performing the printing process to enter the first coupling state and enables the switching circuit U[j] of the j-th stage performing the ejecting malfunction detection process to enter the second coupling state. That is, the ejecting malfunction detection circuit 52 can detect the presence or absence of the ejecting malfunction and specify the cause of the ejecting malfunction during the ejecting operation which is the printing process and in which the liquid is ejected from the nozzle N. Accordingly, for example, by performing the ejecting malfunction process on the nozzle N that does not eject ink, it is possible to detect whether or not the ejecting malfunction occurs in the nozzle N without decreasing the printing speed of the image formed on the medium P.

1.6 Configuration and Operation of Ejecting Malfunction Detection Circuit

Figure 20:
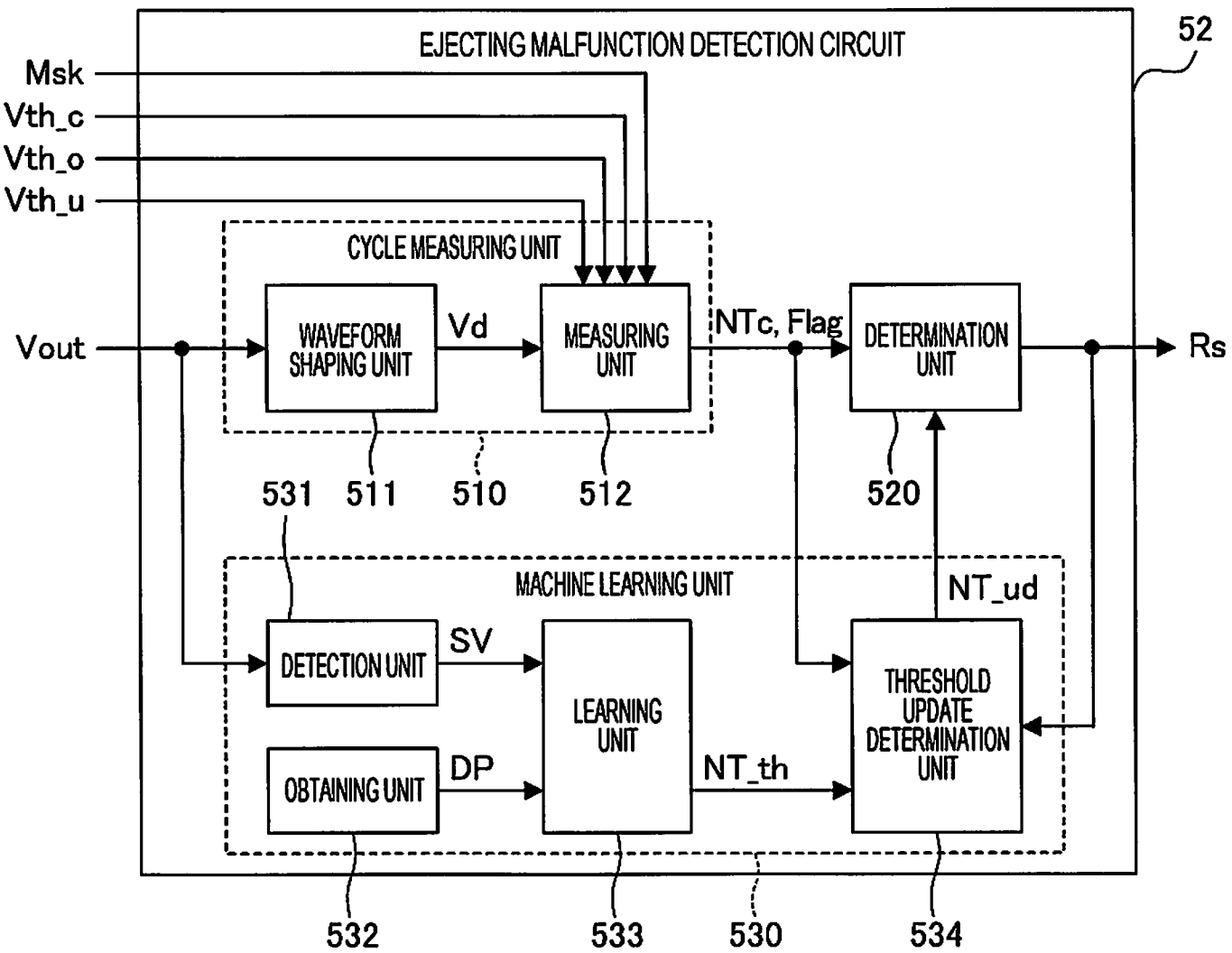
FIG. 20 is a block diagram illustrating a configuration of the ejecting malfunction detection circuit.

A configuration of the ejecting malfunction detection circuit 52 that detects the ejecting malfunction occurring in the nozzle N will be described. FIG. 20 is a block diagram illustrating the configuration of the ejecting malfunction detection circuit 52. The ejecting malfunction detection circuit 52 detects, as the residual vibration signal Vout, a change of the vibration plate 243 caused based on a change in pressure of the cavity 245 after the drive waveform signal Com is supplied to the piezoelectric elements 200. The ejecting malfunction detection circuit 52 detects the presence or absence of the ejecting malfunction of the nozzle N and specifies the cause of the ejecting malfunction based on the residual vibration signal Vout. In FIG. 20, one ejecting malfunction detection circuit 52 is illustrated. Each of various configurations illustrated in FIG. 20 is configured with one or a plurality of integrated circuit devices, processors, or the like.

As illustrated in FIG. 20, the ejecting malfunction detection circuit 52 includes a cycle measuring unit 510, a determination unit 520, and a machine learning unit 530. The cycle measuring unit 510 outputs a detection signal NTc based on the residual vibration signal Vout. The detection signal NTc represents the length of time of one cycle of the residual vibration of the liquid ejecting head 35. The cycle measuring unit 510 includes a waveform shaping unit 511 and a measuring unit 512. The waveform shaping unit 511 generates a shaped waveform signal Vd that is obtained by removing a noise component from the residual vibration signal Vout. The measuring unit 512 measures the cycle of the residual vibration signal Vout and generates the detection signal NTc based on the shaped waveform signal Vd.

For example, the waveform shaping unit 511 includes a high-pass filter, a low-pass filter, and the like and includes a configuration capable of outputting the shaped waveform signal Vd obtained by limiting the frequency range of the residual vibration signal Vout and removing the noise component. The high-pass filter is used for outputting a signal that is obtained by damping a frequency component of a bandwidth lower than the frequency bandwidth of the residual vibration signal Vout. The low-pass filter is used for outputting a signal that is obtained by damping a frequency component of a bandwidth higher than the frequency bandwidth of the residual vibration signal Vout. The waveform shaping unit 511 may be configured to include a negative feedback type amplifier, a voltage follower, and the like. The negative feedback type amplifier is used for adjusting the amplitude of the residual vibration signal Vout. The voltage follower is used for outputting the shaped waveform signal Vd of a low impedance by converting the impedance of the residual vibration signal Vout.

The shaped waveform signal Vd obtained by shaping the residual vibration signal Vout in the waveform shaping unit 511, a mask signal Msk generated by the control unit 6, and threshold potentials Vth_c, Vth_o, and Vth_u are input into the measuring unit 512. The threshold potential Vth_c is a threshold that is set to the level of the potential at the center of the amplitude of the shaped waveform signal Vd. The threshold potential Vth_o is a threshold that is set on a high potential side of the threshold potential Vth_c. The threshold potential Vth_u is a threshold that is set on a low potential side of the threshold potential Vth_c. Based on the input signals, the measuring unit 512 outputs the detection signal NTc and a validity flag that indicates whether or not the value of the detection signal NTc is valid.

Figure 21:
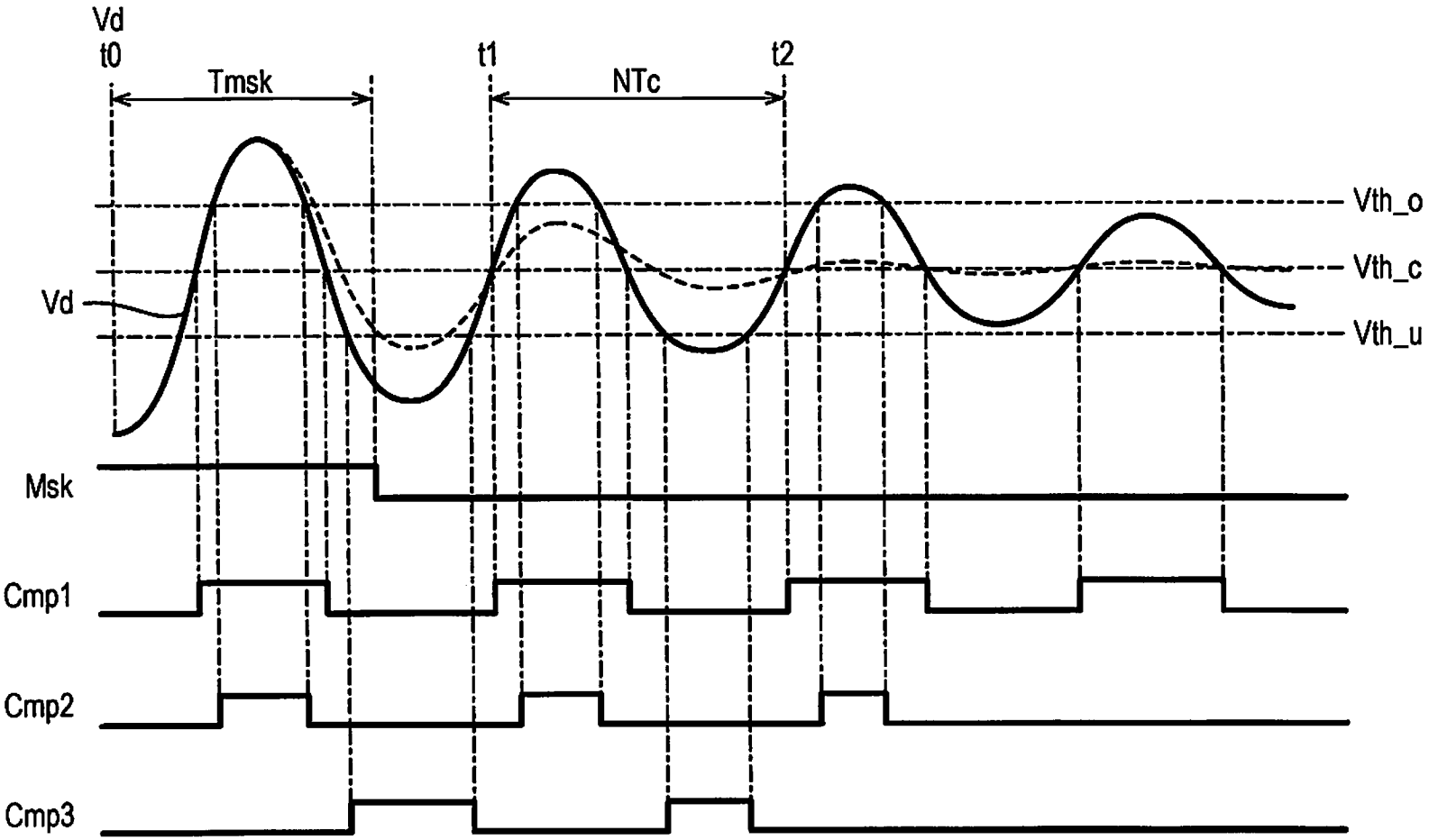
FIG. 21 is a timing chart illustrating an operation of a measuring unit.

FIG. 21 is a timing chart illustrating the operation of the measuring unit 512. As illustrated in FIG. 21, the measuring unit 512 compares the potential of the shaped waveform signal Vd with the threshold potential Vth_c. The measuring unit 512 generates a comparison signal Cmp1 that is set to the high level when the potential of the shaped waveform signal Vd is greater than or equal to the threshold potential Vth_c, and that is set to the low level when the potential of the shaped waveform signal Vd is less than the threshold potential Vth_c.

The measuring unit 512 compares the potential of the shaped waveform signal Vd with the threshold potential Vth_o. The measuring unit 512 generates a comparison signal Cmp2 that is set to the high level when the potential of the shaped waveform signal Vd is greater than or equal to the threshold potential Vth_o, and that is set to the low level when the potential of the shaped waveform signal Vd is less than the threshold potential Vth_o.

The measuring unit 512 compares the potential of the shaped waveform signal Vd with the threshold potential Vth_u. The measuring unit 512 generates a comparison signal Cmp3 that is set to the high level when the potential of the shaped waveform signal Vd is less than the threshold potential Vth_u, and that is set to the low level when the potential of the shaped waveform signal Vd is greater than or equal to the threshold potential Vth_u.

The mask signal Msk is a signal that is set to the high level for a predetermined period Tmsk from time t0 at which the supply of the shaped waveform signal Vd is started. By generating the detection signal NTc using only the shaped waveform signal Vd after the elapse of the period Tmsk as a target, the measuring unit 512 can obtain the high accuracy detection signal NTc in which the noise component superimposed immediately after the start of the residual vibration is removed.

The measuring unit 512 includes a counter not illustrated. The counter starts counting a clock signal, not illustrated, at time t1 that is a timing at which the potential of the shaped waveform signal Vd becomes equal to the threshold potential Vth_c after the mask signal Msk falls to the low level. That is, the counter starts counting at time t1 that is the earlier timing of a timing of the first rise of the comparison signal Cmp1 to the high level or a timing of the first fall of the comparison signal Cmp1 to the low level after the mask signal Msk falls to the low level.

The counter finishes counting the clock signal at time t2 that is a timing at which the potential of the shaped waveform signal Vd is set to the threshold potential Vth_c for the second time after the start of counting. That is, the counter finishes counting at time t2 that is the earlier timing of a timing of the second rise of the comparison signal Cmp1 to the high level or a timing of the second fall of the comparison signal Cmp1 to the low level after the mask signal Msk falls to the low level.

The measuring unit 512 outputs a count value obtained by the counter as the detection signal NTc. That is, the measuring unit 512 generates the detection signal NTc by measuring the length of time from time t1 to time t2 as the length of time of one cycle of the shaped waveform signal Vd.

When the amplitude of the shaped waveform signal Vd is small as illustrated by a dotted line in FIG. 21, the detection signal NTc may not be accurately measured. In addition, even when it is determined that the ejecting state of the liquid ejecting head 35 is normal based on only the result of the detection signal NTc, the ejecting malfunction such as a state in which ink cannot be ejected because ink is not injected into the cavity 245 may be actually present when the amplitude of the shaped waveform signal Vd is small. Therefore, the measuring unit 512 determines whether or not the shaped waveform signal Vd has a sufficient amplitude for measuring the detection signal NTc. The measuring unit 512 outputs the result of the determination as the validity flag Flag.

Specifically, in a period in which the counter executes counting, that is, in a period from time t1 to time t2, when the potential of the shaped waveform signal Vd exceeds the threshold potential Vth_o and is below the potential threshold Vth_u, the measuring unit 512 sets the value of the validity flag Flag to a value "1" that indicates that the detection signal NTc is valid. Otherwise, the measuring unit 512 sets the value of the validity flag Flag to "0". Then, the measuring unit 512 outputs the validity flag Flag. More specifically, in the period from time t1 to time t2, when the comparison signal Cmp2 rises to the high level from the low level and again falls to the low level and the comparison signal Cmp3 rises to the high level from the low level and again falls to the low level, the measuring unit 512 sets the value of the validity flag Flag to "1". Otherwise, the measuring unit 512 sets the value of the validity flag Flag to "0".

As described thus far, the measuring unit 512 generates the detection signal NTc indicating the length of time of one cycle of the shaped waveform signal Vd and also determines whether or not the shaped waveform signal Vd has a sufficient amplitude for measuring the detection signal NTc. Accordingly, the ejecting malfunction detection circuit 52 can more accurately detect the presence or absence of the ejecting malfunction.

Returning to FIG. 20, the determination unit 520 detects the presence or absence of the ejecting malfunction and specifies the cause of the ejecting malfunction based on the cycle of the shaped waveform signal Vd and the predetermined thresholds. The determination unit 520 outputs the determination result signal Rs that indicates the determination result of the presence or absence of the ejecting malfunction and the cause of the ejecting malfunction.

FIG. 22 is a diagram for describing the content of determination in the determination unit 520. As illustrated in FIG. 22, the determination unit 520 compares the length of time of the detection signal NTc with a first threshold NTx1, a second threshold NTx2 representing a length of time longer than the first threshold NTx1, and a third threshold NTx3 representing a length of time further longer than the second threshold NTx2.

The first threshold NTx1 is a value for indicating a boundary between the length of time of one cycle of the residual vibration when the frequency of the residual vibration is increased due to the occurrence of the air bubble entrance as the cause of the ejecting malfunction, and the length of time of one cycle of the residual vibration when the ejecting state is normal. The second threshold NTx2 is a value for indicating a boundary between the length of time of one cycle of the residual vibration when the frequency of the residual vibration is decreased due to the occurrence of the paper dust clinging as the cause of the ejecting malfunction, and the length of time of one cycle of the residual vibration when the ejecting state is normal. The third threshold NTx3 is a value for indicating a boundary between the length of time of one cycle of the residual vibration when the frequency of the residual vibration is further decreased from the frequency of the residual vibration in the case of the paper dust clinging due to the occurrence of the dry thickening as the cause of the ejecting malfunction, and the length of time of one cycle of the residual vibration when paper dust clings around the outlet of the nozzle N.

As illustrated in FIG. 22, when the value of the validity flag Flag is "1", and the detection signal NTc satisfies a relationship "NTx1≤NTc≤NTx2", the determination unit 520 determines that the ejecting state of ink in the liquid ejecting head 35 is normal. The determination unit 520 sets the determination result signal Rs to a value "1" that indicates that the ejecting state is normal.

When the value of the validity flag Flag is "1", and the detection signal NTc satisfies a relationship "NTc<NTx1", the determination unit 520 determines that the ejecting malfunction occurs due to an air bubble entering into the cavity 245. The determination unit 520 sets the determination result signal Rs to a value "2" that indicates that the ejecting malfunction of the air bubble entrance occurs.

When the value of the validity flag Flag is "1", and the detection signal NTc satisfies a relationship "NTx2<NTc≤NTx3", the determination unit 520 determines that the ejecting malfunction occurs due to paper dust clinging around the outlet of the nozzle N. The determination unit 520 sets the determination result signal Rs to a value "3" that indicates that the ejecting malfunction of the paper dust clinging occurs.

When the value of the validity flag Flag is "1", and the detection signal NTc satisfies a relationship "NTx3<NTc", the determination unit 520 determines that the ejecting malfunction occurs due to thickening of ink around the nozzle N. The determination unit 520 sets the determination result signal Rs to a value "4" that indicates that the ejecting malfunction of the dry thickening occurs.

When the value of the validity flag Flag is "0", the determination unit 520 sets a value "5" that indicates that the ejecting malfunction occurs due to any cause such that ink is not injected.

As described thus far, the determination unit 520 includes, as the predetermined thresholds, the first threshold NTx1, the second threshold NTx2 which is set in a cycle longer than the first threshold NTx1, and the third threshold NTx3 which is set in a cycle longer than the second threshold NTx2. When the cycle of the residual vibration signal Vout is less than the first threshold NTx1, the determination unit 520 determines that the cause of the ejecting malfunction is the air bubble entrance. When the cycle of the residual vibration signal Vout exceeds the second threshold NTx2 and is less than or equal to the third threshold NTx3, the determination unit 520 determines that the cause of the ejecting malfunction is the paper dust clinging. When the cycle of the residual vibration signal Vout exceeds the third threshold NTx3, the determination unit 520 determines that the cause of the ejecting malfunction is the dry thickening. That is, the determination unit 520 determines whether or not the ejecting malfunction occurs in the liquid ejecting head 35. When the ejecting malfunction occurs, the determination unit 520 specifies at least one of the air bubble entrance, the dry thickening, and the paper dust clinging as the cause of the ejecting malfunction and outputs the specified cause to the control unit 6 as the determination result signal Rs. When the ejecting malfunction occurs, the control unit 6 causes the recovery mechanism 84 to execute the recovery process. Details of the recovery process in the recovery mechanism 84 will be described below.

As described thus far, the ejecting malfunction detection circuit 52 detects the presence or absence of the ejecting malfunction of the nozzle N and specifies the cause of the ejecting malfunction based on the residual vibration signal Vout. However, the cycle of the residual vibration signal Vout may vary due to variation in waveform of the drive signal Vin, physical properties of ink supplied to the liquid ejecting head 35, a usage environment of the liquid ejecting apparatus 1, a change in characteristics of various components constituting the liquid ejecting apparatus 1, and the like. Thus, when the first threshold NTx1, the second threshold NTx2, and the third threshold NTx3 are set as predetermined fixed thresholds, the ejecting state of ink in the ejecting malfunction detection circuit 52 may not be accurately determined.

Therefore, the ejecting malfunction detection circuit 52 in the present embodiment includes the machine learning unit 530 that generates a signal for updating the first threshold NTx1, the second threshold NTx2, and the third threshold NTx3. As illustrated in FIG. 20, the machine learning unit 530 includes a detection unit 531, an obtaining unit 532, and a learning unit 533. The detection unit 531 detects the residual vibration signal Vout. The obtaining unit 532 obtains information that indicates the ejecting state of ink ejected from the nozzle N. The learning unit 533 obtains, by machine learning, a relationship between the residual vibration signal and the ejecting state of ink. The learning unit 533 generates a learning threshold signal NT_th based on the relationship, obtained by machine learning, between the residual vibration signal Vout and the ejecting state. The learning threshold signal NT_th indicates the presence or absence of the ejecting malfunction of the liquid ejecting head 35. The first threshold NTx1, the second threshold NTx2, and the third threshold NTx3 are updated based on the learning threshold signal NT_th.

The machine learning unit 530 includes the detection unit 531, the obtaining unit 532, the learning unit 533, and a threshold update determination unit 534.

The residual vibration signal Vout is input into the detection unit 531. The detection unit 531 detects, from the waveform of the input residual vibration signal Vout, waveform data of the residual vibration such as the maximum voltage, the minimum voltage, the amplitude, the vibration cycle, the vibration continuation time period, the damping ratio of the vibration amplitude, and the like of the residual vibration that are included in the residual vibration signal Vout. The detection unit 531 outputs the detected waveform data as a state variable SV.

The obtaining unit 532 detects whether or not ink is actually ejected from the liquid ejecting head 35. For example, the obtaining unit 532 may detect whether or not ink is ejected to the medium P using an optical method. In addition, for example, the obtaining unit 532 may detect whether or not ink is ejected to the medium P using a camera. In addition, for example, the obtaining unit 532 may detect whether or not ink is ejected to the medium P based on the amplitude and the cycle of the waveform of the residual vibration and the continuation time period, the damping ratio, and the like of the residual vibration. The obtaining unit 532 outputs information indicating the obtained ejecting state of ink to the learning unit 533 as an ejecting information signal DP.

The learning unit 533 learns the relationship between the residual vibration signal Vout and the ejecting state in accordance with a learning model that is created based on a combination of the state variable SV detected by the detection unit 531 and the ejecting information signal DP indicating whether or not ink is actually ejected. The learning unit 533 generates a learning threshold NTx1*a* corresponding to the first threshold NTx1, a learning threshold NTx2*a* corresponding to the second threshold NTx2, and a learning threshold NTx3*a* corresponding to the third threshold NTx3 in accordance with the learning model created based on the combination of the state variable SV detected by the detection unit 531 and the ejecting information signal DP indicating whether or not ink is actually ejected. The learning unit 533 creates the learning threshold signal NT_th indicating the learning thresholds NTx1*a*, NTx2*a*, and NTx3*a* and outputs the learning threshold signal NT_th to the threshold update determination unit 534.

The learning threshold signal NT_th, the detection signal NTc, the validity flag Flag, and the determination result signal Rs are input into the threshold update determination unit 534. The threshold update determination unit 534 determines whether or not to update the current first threshold NTx1, second threshold NTx2, and third threshold NTx3 based on the learning threshold signal NT_th, the detection signal NTc, the validity flag Flag, and the determination result signal Rs. The threshold update determination unit 534 generates and outputs a threshold update signal NT_ud based on the determination result.

Specifically, when the value of the validity flag Flag is "1", and the detection signal NTc satisfies a relationship "NTx1*a*≤NTc≤NTx2*a*", the threshold update determination unit 534 determines that it is necessary to decrease the first threshold NTx1 in a case in which the determination result signal Rs which is set to the value "2" indicating that the ejecting malfunction occurs due to an air bubble is input. Accordingly, the threshold update determination unit 534 generates and outputs the threshold update signal NT_ud for updating the first threshold NTx1 such that the first threshold NTx1 is separated from the second threshold NTx2.

When the value of the validity flag Flag is "1", and the detection signal NTc satisfies a relationship "NTx1*a*≤NTc≤NTx2*a*", the threshold update determination unit 534 determines that it is necessary to increase the second threshold NTx2 in a case in which the determination result signal Rs which is set to the value "3" indicating that the ejecting malfunction occurs due to paper dust is input. Accordingly, the threshold update determination unit 534 generates and outputs the threshold update signal NT_ud for updating the second threshold NTx2 such that the second threshold NTx2 is separated from the first threshold NTx1.

When the value of the validity flag Flag is "1", and the detection signal NTc satisfies a relationship "NTc<NTx1*a*", the threshold update determination unit 534 determines that it is necessary to increase the first threshold NTx1 in a case in which the determination result signal Rs which is set to the value "1" indicating that the ejecting state is normal is input. Accordingly, the threshold update determination unit 534 generates and outputs the threshold update signal NT_ud for updating the first threshold NTx1 such that the first threshold NTx1 is set close to the second threshold NTx2.

When the value of the validity flag Flag is "1", and the detection signal NTc satisfies a relationship "NTx2*a*<NTc≤NTx3*a*", the threshold update determination unit 534 determines that it is necessary to decrease the second threshold NTx2 in a case in which the determination result signal Rs which is set to the value "1" indicating that the ejecting state is normal is input. Accordingly, the threshold update determination unit 534 generates and outputs the threshold update signal NT_ud for updating the second threshold NTx2 such that the second threshold NTx2 is set close to the first threshold NTx1.

When the value of the validity flag Flag is "1", and the detection signal NTc satisfies a relationship "NTx2*a*<NTc≤NTx3*a*", the threshold update determination unit 534 determines that it is necessary to increase the third threshold NTx3 in a case in which the determination result signal Rs which is set to the value "4" indicating that the ejecting malfunction occurs due to ink thickening is input. Accordingly, the threshold update determination unit 534 generates and outputs the threshold update signal NT_ud for updating the third threshold NTx3 such that the third threshold NTx3 is separated from the second threshold NTx2.

When the value of the validity flag Flag is "1", and the detection signal NTc satisfies a relationship "NTx3*a*<NTc", the threshold update determination unit 534 determines that it is necessary to decrease the third threshold NTx3 in a case in which the determination result signal Rs which is set to the value "3" indicating that the ejecting malfunction occurs due to paper dust is input. Accordingly, the threshold update determination unit 534 generates and outputs the threshold update signal NT_ud for updating the third threshold NTx3 such that the third threshold NTx3 is set close to the second threshold NTx2.

Figure 23:
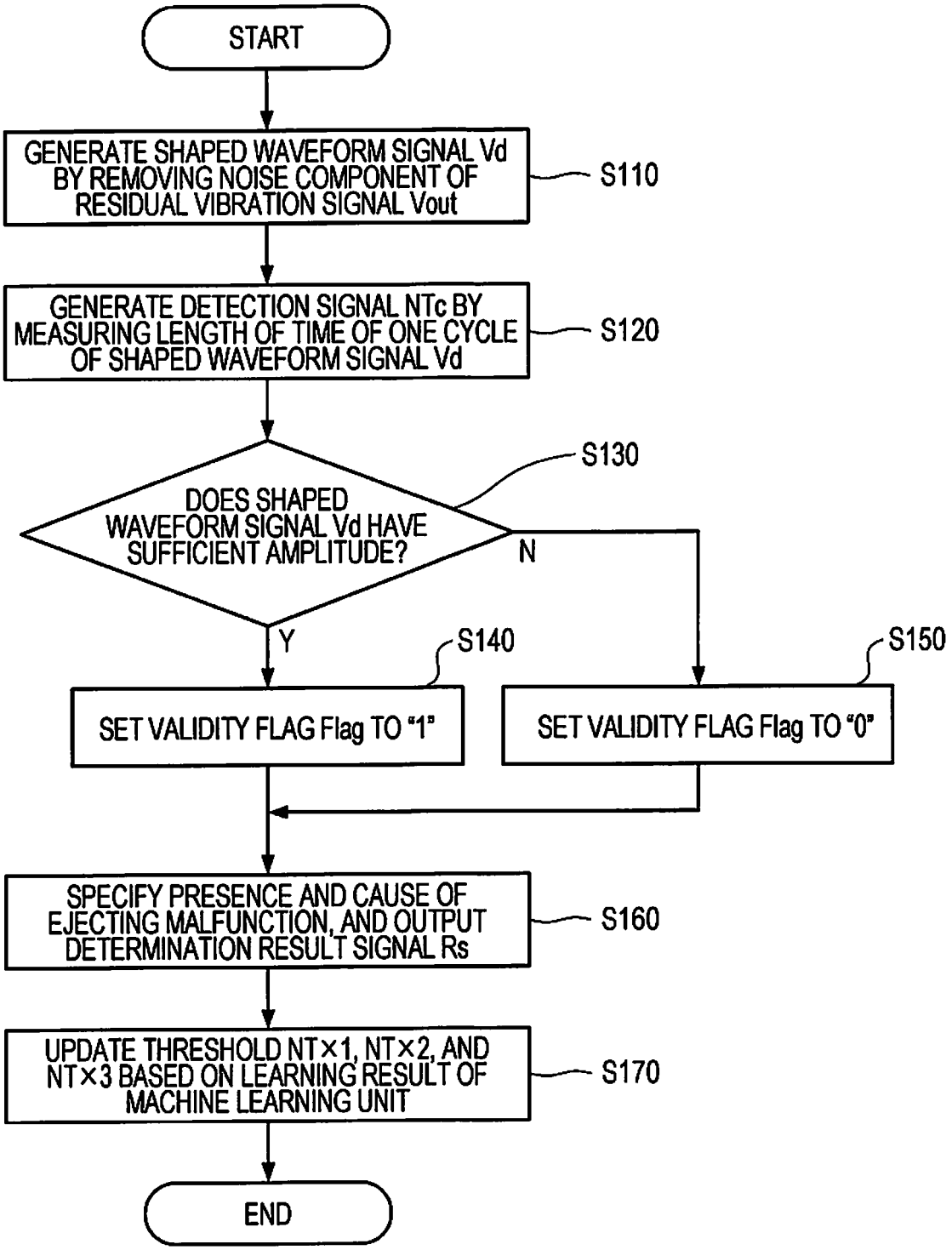
FIG. 23 is a flowchart illustrating a method of an ejecting malfunction detection process in the ejecting malfunction detection circuit.

An ejecting malfunction detection method and a machine learning method as a liquid ejecting method for the liquid ejecting apparatus 1 will be described using FIG. 23 and FIG. 24. The ejecting malfunction detection method in the ejecting malfunction detection circuit 52 will be described. FIG. 23 is a flowchart illustrating a method of the ejecting malfunction detection process in the ejecting malfunction detection circuit 52.

As the ejecting malfunction detection process of the ejecting malfunction detection circuit 52, the waveform shaping unit 511 included in the cycle measuring unit 510 generates the shaped waveform signal Vd by removing the noise component of the input residual vibration signal Vout (step S110).

The shaped waveform signal Vd is input into the measuring unit 512. The measuring unit 512 generates the detection signal NTc by measuring the length of time of one cycle of the shaped waveform signal Vd (step S120).

The measuring unit 512 determines whether or not the shaped waveform signal Vd has a sufficient amplitude (step S130). When the shaped waveform signal Vd has a sufficient amplitude, the measuring unit 512 sets the validity flag Flag to "1" (step S140). When the shaped waveform signal Vd does not have a sufficient amplitude, the measuring unit 512 sets the validity flag Flag to "0" (step S150).

The detection signal NTc and the validity flag Flag are input into the determination unit 520. The determination unit 520 specifies the presence or absence of the ejecting malfunction of ink in the nozzle N and the cause of the ejecting malfunction based on the input detection signal NTc and the validity flag Flag, the first threshold NTx1, the second threshold NTx2, and the third threshold NTx3. The determination unit 520 outputs the determination result signal Rs (step S160).

The machine learning unit 530 learns the relationship between the residual vibration signal Vout and the ejecting state based on the residual vibration signal Vout and the actual ejecting state of the nozzle N. The machine learning unit 530 updates the first threshold NTx1, the second threshold NTx2, and the third threshold NTx3 based on the learning result and the determination result signal Rs (step S170).

The machine learning method of the machine learning unit 530 in step S170 of FIG. 23 will be described. FIG. 24 is a flowchart illustrating the machine learning method in the machine learning unit 530.

The residual vibration signal Vout is input into the detection unit 531 included in the machine learning unit 530.

The detection unit 531 detects the residual vibration signal Vout (step S171). The detection unit 531 generates the state variable SV based on the signal waveform of the residual vibration signal Vout (step S172). The obtaining unit 532 obtains a signal indicating the actual ejecting state of ink ejected from the nozzle N (step S173). The obtaining unit 532 generates the ejecting information signal DP indicating the obtained ejecting state of ink (step S174).

The state variable SV and the ejecting information signal DP are input into the learning unit 533. The learning unit 533 obtains, by machine learning, the relationship between the state variable SV and the ejecting information signal DP (step S175). The learning unit 533 generates the learning threshold signal NT_th including the learning thresholds NTx1*a*, NTx2*a*, and NTx3*a* based on the learning result of the machine learning.

The threshold update determination unit 534 updates the first threshold NTx1, the second threshold NTx2, and the third threshold NTx3 based on the determination result signal Rs and the learning thresholds NTx1*a*, NTx2*a*, and NTx3*a* input as the learning threshold signal NT_th (step S176).

Figure 24:
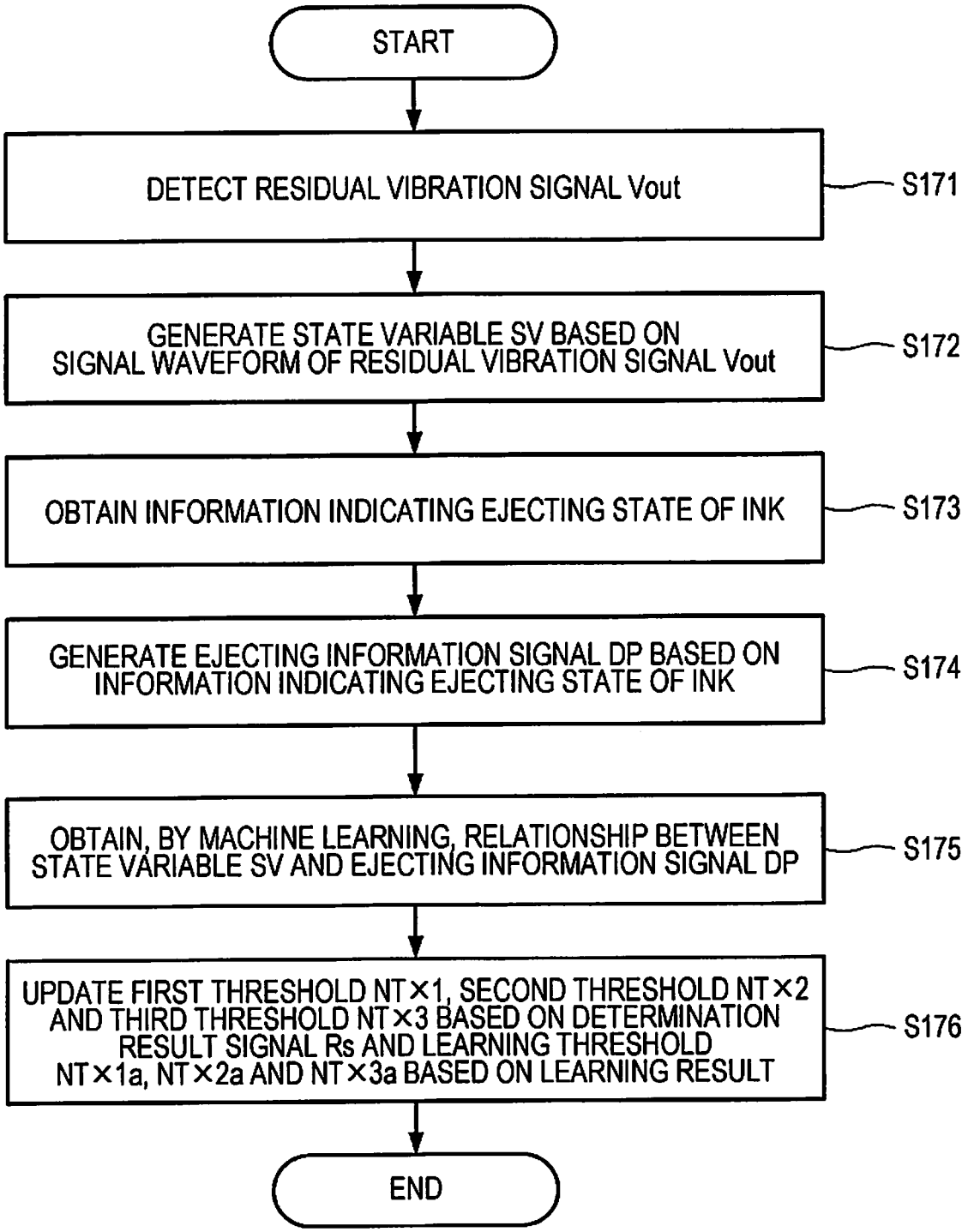
FIG. 24 is a flowchart illustrating a machine learning method in a machine learning unit.

By the methods illustrated in FIG. 23 and FIG. 24, the ejecting malfunction detection circuit 52 specifies the presence or absence of the ejecting malfunction and the cause of the ejecting malfunction for the nozzle N. Furthermore, the first threshold NTx1, the second threshold NTx2, and the third threshold NTx3 are updated based on the learning model obtained by learning the relationship between the residual vibration signal Vout and the actual ejecting state of the nozzle N. Accordingly, even when the cycle of the residual vibration signal Vout varies due to variation in waveform of the residual vibration signal Vout, physical properties of ink supplied to the liquid ejecting head 35, the usage environment of the liquid ejecting apparatus 1, a change in characteristics of various components constituting the liquid ejecting apparatus 1, and the like, the presence or absence of the ejecting malfunction and the cause of the ejecting malfunction can be specified using an optimal threshold. Accordingly, the detection accuracy of the ejecting state of ink in the ejecting malfunction detection circuit 52 can be increased.

In the ejecting malfunction detection circuit 52, the learning unit 533 that obtains, by machine learning, the relationship between the state variable SV, which is based on the residual vibration signal Vout, and the ejecting information signal DP indicating the ejecting state of ink actually ejected from the nozzle N and that generates the learning threshold signal NT_th indicating the learning thresholds NTx1*a*, NTx2*a*, and NTx3*a* is one example of a learning unit in a narrow sense. However, when the learning unit is configured to obtain, by machine learning, the relationship between the state variable SV and the ejecting information signal DP and output the threshold update signal NT_ud indicating whether or not to update the first threshold NTx1, the second threshold NTx2, and the third threshold NTx3, a configuration that includes the learning unit 533 and the threshold update determination unit 534 is also one example of the learning unit. In addition, when the learning unit is configured to obtain, by machine learning, the relationship between the state variable SV and the ejecting information signal DP and output the determination result signal Rs representing the ejecting state of ink in the liquid ejecting head 35, a configuration that includes the learning unit 533, the threshold update determination unit 534, and the determination unit 520 is also one example of the learning unit.

1.7 Operation of Recovery Process

The recovery process of the recovery mechanism 84 in which the state of the nozzle N in which the ejecting malfunction is detected is recovered when the ejecting malfunction is detected by the ejecting malfunction detection circuit 52 will be described. The recovery mechanism 84 includes the pump suction process, the flushing process, and the wiping process as the recovery process.

Figure 25:
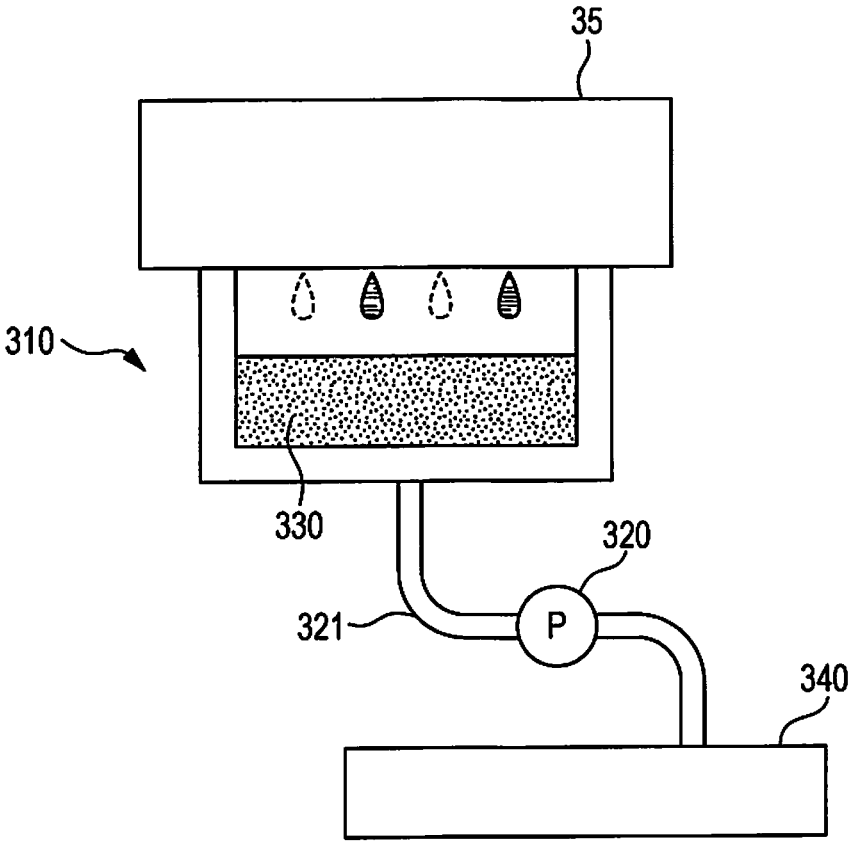
FIG. 25 is a diagram illustrating one example of a pump suction process.

FIG. 25 is a diagram illustrating one example of the pump suction process. A tube 321 illustrated in FIG. 25 includes a discharge system of ink in the pump suction process. One end of the tube 321 is coupled to the bottom portion of a cap 310. Another end of the tube 321 is coupled to a discharged ink cartridge 340 through a pump 320.

An ink absorbing object 330 is disposed on the inner bottom surface of the cap 310. The ink absorbing object 330 absorbs and temporarily retains ink ejected from the nozzle N in the pump suction process. Accordingly, when the pump suction process is executed, a concern that suctioned ink splashes back and clings to the nozzle plate 240 can be reduced.

Figure 26A:
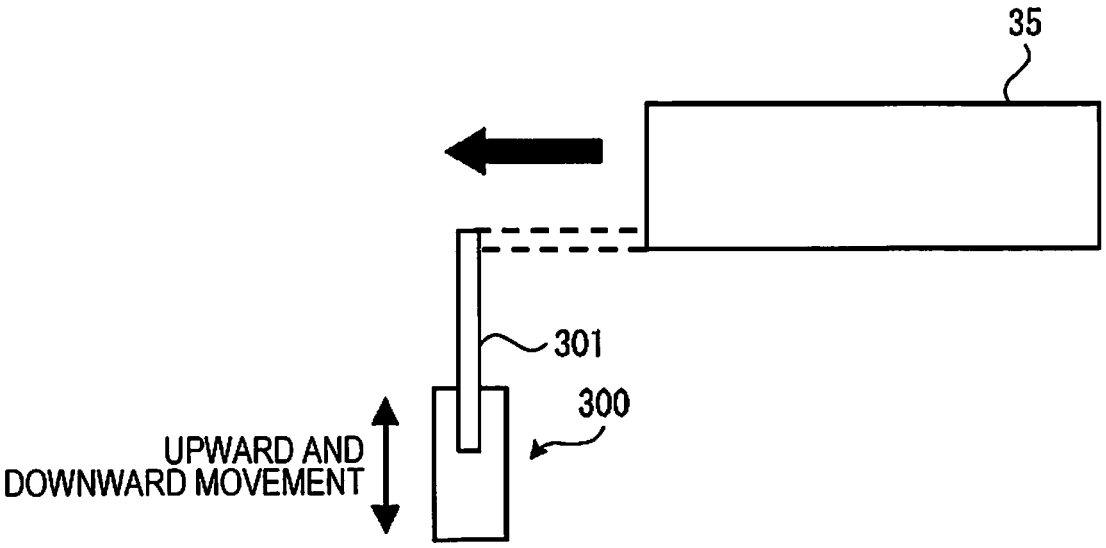
FIGS. 26A and 26B are diagrams illustrating one example of a wiping process.
Figure 26B:
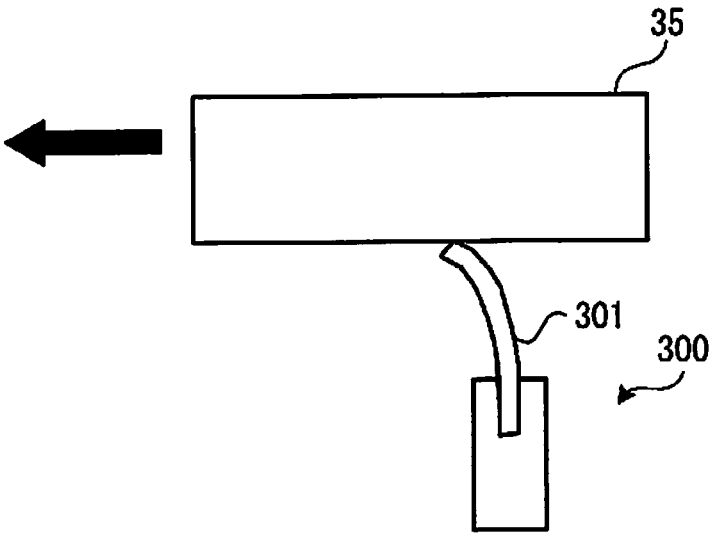

FIGS. 26A and 26B are diagrams illustrating one example of the wiping process. As illustrated in FIG. 26A, a wiper 300 is disposed to be movable upward and downward such that the wiper 300 can abut the nozzle plate 240. When the wiping process is executed, a wiping member 301 that is disposed at the tip end of the wiper 300 moves to a position above the nozzle plate 240. The liquid ejecting head 35 is moved by driving the carriage motor 41. Accordingly, as illustrated in FIG. 26B, the wiping member 301 abuts the nozzle plate 240. The wiping member 301 is made of plastic rubber or the like. Accordingly, when the wiping member 301 abuts the nozzle plate 240, the tip end portion of the wiping member is bent. Accordingly, the surface of the nozzle plate 240 can be wiped by the wiping member 301, and paper dust and the like clinging to the nozzle plate 240 can be removed.

In the flushing process, for example, in a state in which the cap 310 illustrated in FIG. 25 is mounted, one or a plurality liquid ejecting heads 35 including the liquid ejecting head 35 as a target are driven, and ink is ejected from the corresponding nozzle N. By performing the flushing process, the viscosity of ink retained in the liquid ejecting head 35 can be maintained in an appropriate range, or the viscosity of ink can be recovered.

The recovery process is executed depending on the ejecting malfunction specified by the ejecting malfunction detection circuit 52. Specifically, when the cause of the ejecting malfunction specified by the ejecting malfunction detection circuit 52 is the air bubble entrance, the recovery mechanism 84 executes the pump suction process. When the cause of the ejecting malfunction specified by the ejecting malfunction detection circuit 52 is the dry thickening, the recovery mechanism 84 executes the flushing process or the pump suction process. When the cause of the ejecting malfunction specified by the ejecting malfunction detection circuit 52 is the paper dust clinging, the recovery mechanism 84 executes the wiping process.

After the recovery process is executed, the recovery mechanism 84 ejects ink from one or a plurality of nozzles N including the nozzle N that is one example of a malfunctioning nozzle in which the ejecting malfunction occurs. The ejecting malfunction detection circuit 52 detects the presence or absence of the ejecting malfunction again for the nozzle N in which the ejecting malfunction occurs. Accordingly, it is possible to determine whether or not the recovery process executed on the nozzle N in which the ejecting malfunction occurs normally functions.

When the ejecting malfunction is detected in the ejecting malfunction detection circuit 52, the recovery mechanism 84 may execute the flushing process on the nozzle N in which the ejecting malfunction is detected. After the execution of the flushing process, ink is ejected from one or a plurality of nozzles N including the nozzle N that is one example of the malfunctioning nozzle in which the ejecting malfunction occurs. The ejecting malfunction detection circuit 52 detects the presence or absence of the ejecting malfunction again for the nozzle N in which the ejecting malfunction occurs. In the detection performed again, the ejecting malfunction detection circuit 52 specifies the presence or absence of the ejecting malfunction and the cause of the ejecting malfunction again for the nozzle N in which the ejecting malfunction occurs. The recovery mechanism 84 executes the recovery process corresponding to the cause specified by the detection performed again by the ejecting malfunction detection circuit 52.

By executing the flushing process on the nozzle N in which the ejecting malfunction is detected, recovery can be made from the ejecting malfunction when the ejecting malfunction is not significant. It is preferable that the nozzle N on which the flushing process is executed is only the nozzle in which the ejecting malfunction occurs. Accordingly, the amount of consumed ink can be reduced.

1.8 Effect

As described thus far, in the liquid ejecting apparatus 1 in the present embodiment, the detection unit 531 included in the ejecting malfunction detection circuit 52 detects, as the residual vibration signal Vout, a change of the vibration plate 243 caused based on a change in pressure of the cavity 245. The obtaining unit 532 included in the ejecting malfunction detection circuit 52 obtains the ejecting state of ink from the nozzle N when the residual vibration signal Vout is obtained. The learning unit 533 obtains, by machine learning, the relationship between the ejecting state, obtained by the obtaining unit 532, of ink from the nozzle N and detection data such as the voltage amplitude, the vibration cycle, the damping ratio, and a time period obtained from the signal waveform of the residual vibration signal Vout detected by the detection unit 531. The ejecting malfunction detection circuit 52 detects the presence or absence of the ejecting malfunction of the nozzle N and specifies the cause of the ejecting malfunction based on the learning result obtained based on the result of the machine learning. Accordingly, the ejecting malfunction detection circuit 52 can obtain (1) a design error of the liquid ejecting apparatus 1, (2) an environment such as a temperature and a humid at which the liquid ejecting apparatus is used, (3) a change in characteristics accompanied by a temporal change in various configurations constituting the liquid ejecting apparatus, and (4) an optimal detection threshold on which physical properties such as the viscosity of used ink are reflected. Accordingly, a concern that the detection accuracy of the ejecting state of ink is decreased is reduced.

2. Second Embodiment

The liquid ejecting apparatus 1 in a second embodiment will be described. In description of the liquid ejecting apparatus 1 in the second embodiment, the same configurations as the first embodiment will be designated by the same reference signs, and descriptions of such configurations will be omitted or simplified. In the liquid ejecting apparatus 1 in the first embodiment, the learning unit 533 of the machine learning unit 530 included in the ejecting malfunction detection circuit 52 learns the relationship between the residual vibration signal Vout and the ejecting state of ink ejected from the nozzle N based on the state variable SV, which depends on the residual vibration signal Vout, and the ejecting information signal DP indicating the actual ejecting state of ink ejected from the nozzle N. However, the ejecting malfunction detection circuit 52 in the second embodiment is different from the liquid ejecting apparatus 1 of the first embodiment in that the relationship between the residual vibration signal Vout and the ejecting state of ink ejected from the nozzle N is learned outside the ejecting malfunction detection circuit 52, and the learning model obtained by the learning is input and held in the ejecting malfunction detection circuit 52.

Figure 27:
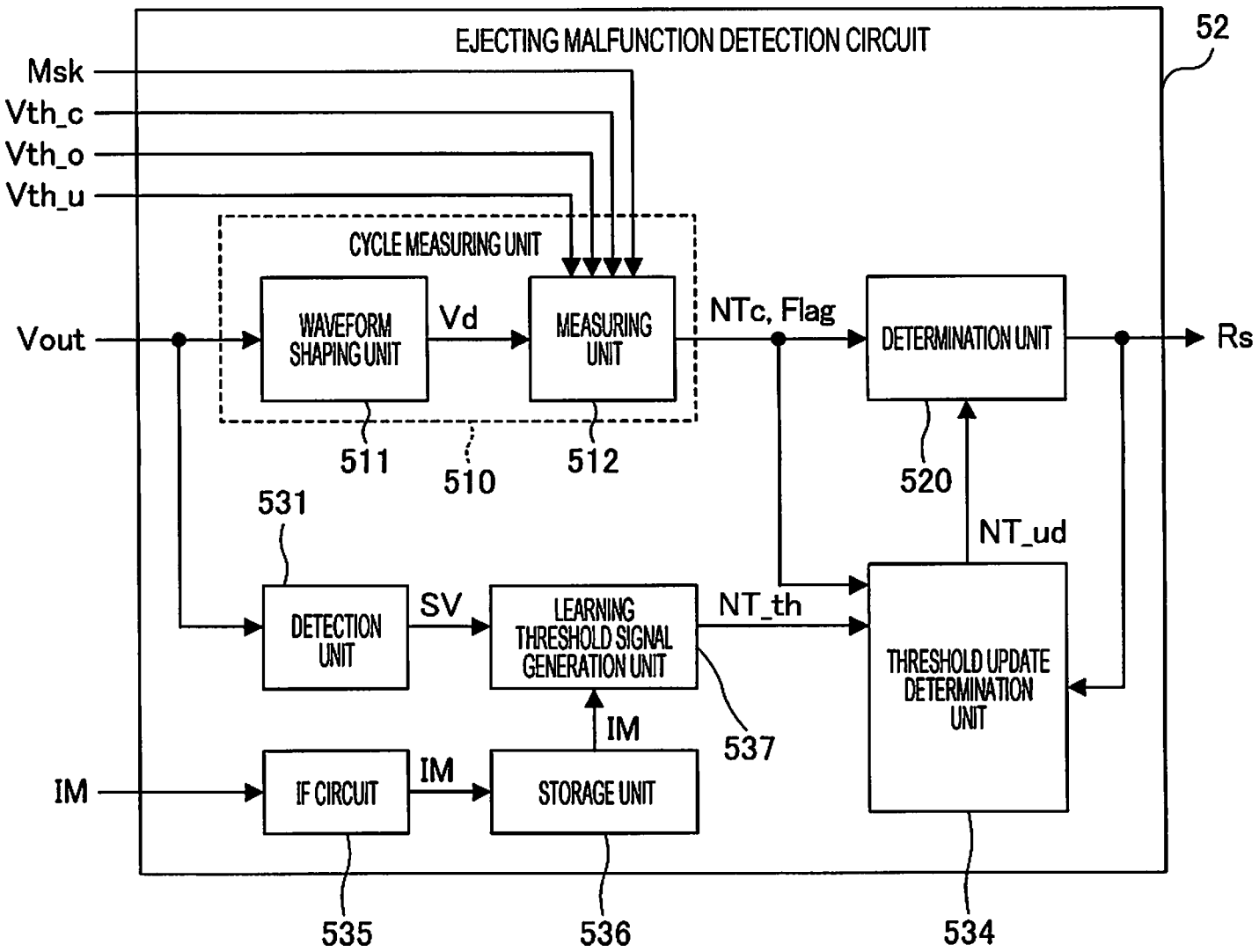
FIG. 27 is a diagram illustrating a configuration of an ejecting malfunction detection circuit in a second embodiment.

FIG. 27 is a diagram illustrating a configuration of the ejecting malfunction detection circuit 52 in the second embodiment. As illustrated in FIG. 27, the ejecting malfunction detection circuit 52 in the second embodiment includes the cycle measuring unit 510, the determination unit 520, the detection unit 531, a learning threshold signal generation unit 537, an interface circuit (IF circuit) 535, a storage unit 536, and the threshold update determination unit 534. The cycle measuring unit 510 has the same configuration as the first embodiment. Thus, a description of the cycle measuring unit 510 will be omitted.

The residual vibration signal Vout is input into the detection unit 531. The detection unit 531 detects, from the waveform of the input residual vibration signal Vout, the waveform data of the residual vibration waveform including at least one of the maximum voltage, the minimum voltage, the vibration cycle, the vibration continuation time period, and the damping ratio of the vibration amplitude of the residual vibration. The detection unit 531 outputs the detected waveform data as the state variable SV. In other words, the detection unit detects the residual vibration signal Vout.

The interface circuit 535 is disposed to be communicable with an external apparatus such as a host computer or a server, not illustrated, that is disposed outside the liquid ejecting apparatus 1. For example, the interface circuit 535 may be coupled to the external apparatus through the control unit 6. A learning model IM that is obtained by the external apparatus by learning the relationship between residual vibration data and the ejecting state of ink from the nozzle N is input into the interface circuit 535.

The learning model IM input into the interface circuit 535 is stored in the storage unit 536. In other words, the storage unit 536 stores the learning model IM obtained by machine learning the relationship between the residual vibration signal Vout and the ejecting state of ink ejected from the nozzle N. The learning model IM stored in the storage unit 536 is output to the learning threshold signal generation unit 537.

The state variable SV output from the detection unit 531 and the learning model stored in the storage unit 536 are input into the learning threshold signal generation unit 537. The learning threshold signal generation unit 537 generates the learning threshold signal NT_th including the learning thresholds NTx1*a*, NTx2*a*, and NTx3*a* based on the residual vibration signal Vout and the learning model IM. The learning threshold signal generation unit 537 outputs the learning threshold signal NT_th to the threshold update determination unit 534.

The learning threshold signal NT_th, the detection signal NTc, the validity flag Flag, and the determination result signal Rs are input into the threshold update determination unit 534 in the same manner as in the first embodiment. The threshold update determination unit 534 determines whether or not to update the current first threshold NTx1, second threshold NTx2, and third threshold NTx3 based on the learning threshold signal NT_th, the detection signal NTc, the validity flag Flag, and the determination result signal Rs.

The threshold update determination unit 534 generates and outputs the threshold update signal NT_ud based on the determination result.

The detection signal NTc and the validity flag Flag are input into the determination unit 520. The determination unit 520 outputs the determination result signal Rs by determining the length of time of the detection signal NTc using the first threshold NTx1, the second threshold NTx2, and the third threshold NTx3 in the same manner as in the first embodiment. That is, the determination unit 520 determines the presence or absence of the ejecting malfunction of the liquid ejecting head 35 using the first threshold NTx1, the second threshold NTx2, and the third threshold NTx3 generated based on the learning model IM and the state variable SV which depends on the residual vibration signal Vout.

Figure 28:
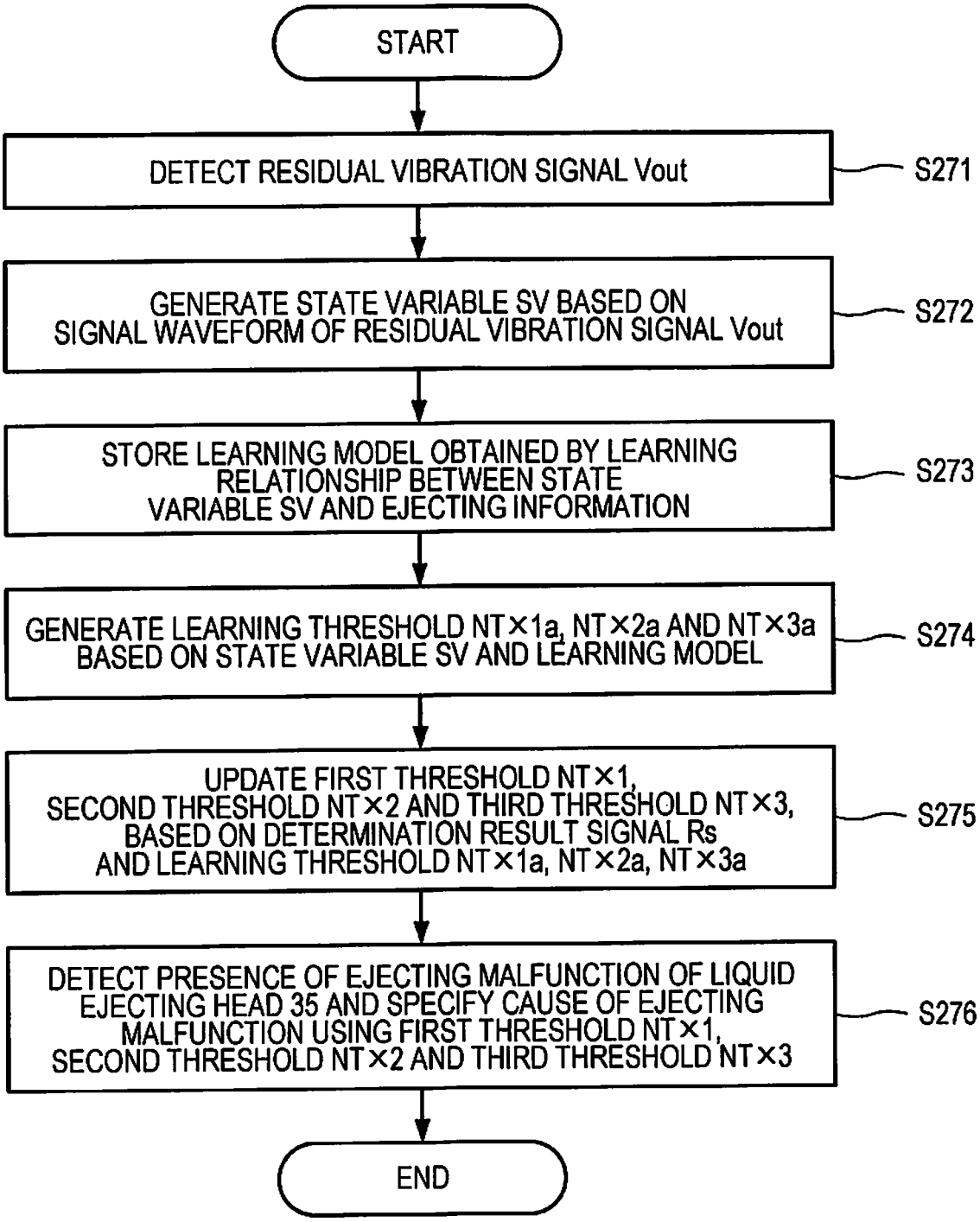
FIG. 28 is a flowchart for describing a liquid ejecting method in the second embodiment.

A method of generating the threshold update signal NT_ud in the machine learning unit 530 in the second embodiment will be described. FIG. 28 is a flowchart for describing a liquid ejecting method in the second embodiment.

The detection unit 531 detects the residual vibration signal Vout (step S271). The detection unit 531 generates the state variable SV based on the signal waveform of the residual vibration signal Vout (step S272). The storage unit 536 stores the learning model IM obtained by learning the ejecting state of ink from the nozzle N and the residual vibration data input through the interface circuit 535 (step S273).

The state variable SV and the learning model IM are input into the learning threshold signal generation unit 537. The learning threshold signal generation unit 537 generates the learning threshold signal NT_th including the learning thresholds NTx1*a*, NTx2*a*, and NTx3*a* based on the state variable SV and the learning model (step S274).

The threshold update determination unit 534 updates the first threshold NTx1, the second threshold NTx2, and the third threshold NTx3, which are held in the determination unit 520, based on the determination result signal Rs and the learning thresholds NTx1*a*, NTx2*a*, and NTx3*a* input as the learning threshold signal NT_th (step S275).

The determination unit 520 specifies the presence or absence of the ejecting malfunction of the liquid ejecting head 35 and the cause of the ejecting malfunction using the length of time of the detection signal NTc and the first threshold NTx1, the second threshold NTx2, and the third threshold NTx3 (step S276).

The liquid ejecting apparatus 1 that includes the ejecting malfunction detection circuit 52 of the second embodiment having the configuration thus far can achieve the same effect as the first embodiment.

While the embodiments and modification examples are described thus far, the present disclosure is not limited to the embodiments and can be embodied in various aspects without departing from the nature of the present disclosure. For example, the embodiments can be appropriately combined.

The present disclosure includes substantially the same configurations (for example, configurations having the function, method, and result or configurations having the same purpose and effect) as the configurations described in the embodiments. The present disclosure includes configurations obtained by replacing a non-substantial part of the configurations described in the embodiments. The present disclosure includes configurations achieving the same effect as the configurations described in the embodiments or configurations capable of accomplishing the same purpose as the configurations described in the embodiments. The present disclosure includes configurations obtained by adding well-known technologies to the configurations described in the embodiments.

What is claimed is:

1. A liquid ejecting apparatus comprising:

a drive signal generation circuit generating a drive waveform signal;

a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity; and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal, wherein the ejecting malfunction detection circuit includes a detection unit detecting the residual vibration signal, an obtaining unit obtaining information indicating an ejecting state of the liquid ejected from the nozzle, and a learning unit machine learning a relationship between the residual vibration signal and the ejecting state.

2. The liquid ejecting apparatus according to claim 1, wherein the learning unit generates a learning threshold signal indicating the presence or absence of the ejecting malfunction of the liquid ejecting head based on the relationship, obtained by machine learning, between the residual vibration signal and the ejecting state.

3. The liquid ejecting apparatus according to claim 2, wherein the ejecting malfunction detection circuit includes a waveform shaping unit, a measuring unit, and a determination unit, the waveform shaping unit generates a shaped waveform signal obtained by removing a noise component from the residual vibration signal, the measuring unit measures a cycle of the residual vibration signal based on the shaped waveform signal, the determination unit detects the presence or absence of the ejecting malfunction and specifies the cause of the ejecting malfunction based on a cycle of the shaped waveform signal and a predetermined threshold, and the predetermined threshold is updated based on the learning threshold signal.

4. A liquid ejecting apparatus comprising:

a drive signal generation circuit generating a drive waveform signal;

a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity; and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal, wherein the ejecting malfunction detection circuit includes a detection unit detecting the residual vibration signal, a storage unit storing a learning model obtained by machine learning a relationship between the residual vibration signal and an ejecting state of the liquid ejected from the nozzle, and a determination unit determining the presence or absence of the ejecting malfunction of the liquid ejecting head based on the residual vibration signal and the learning model.

5. The liquid ejecting apparatus according to claim 4, wherein the ejecting malfunction detection circuit includes a waveform shaping unit, a measuring unit, and a determination unit, the waveform shaping unit generates a shaped waveform signal obtained by removing a noise component from the residual vibration signal, the measuring unit measures a cycle of the residual vibration signal based on the shaped waveform signal, the determination unit detects the presence or absence of the ejecting malfunction and specifies the cause of the ejecting malfunction based on a cycle of the shaped waveform signal and a predetermined threshold, and the predetermined threshold is updated based on the residual vibration signal and the learning model.

6. The liquid ejecting apparatus according to claim 3, wherein the determination unit specifies, as the cause of the ejecting malfunction, at least one of air bubble entrance in which an air bubble enters into the cavity, dry thickening in which the liquid around the nozzle dries and thickens, and paper dust clinging in which paper dust clings around an outlet of the nozzle.

7. The liquid ejecting apparatus according to claim 6, wherein the determination unit includes, as the predetermined threshold, a first threshold, a second threshold set in a cycle longer than the first threshold, and a third threshold set in a cycle longer than the second threshold, when the cycle of the residual vibration signal is less than the first threshold, the determination unit determines that the cause of the ejecting malfunction is the air bubble entrance, when the cycle of the residual vibration signal exceeds the second threshold and is less than or equal to the third threshold, the determination unit determines that the cause of the ejecting malfunction is the paper dust clinging, and when the cycle of the residual vibration signal exceeds the third threshold, the determination unit determines that the cause of the ejecting malfunction is the dry thickening.

8. The liquid ejecting apparatus according to claim 6, further comprising:

an ejecting selection circuit that is electrically coupled to the drive element and that selects whether or not to supply the drive waveform signal to the drive element;

a switching circuit electrically coupled to the liquid ejecting head, the ejecting selection circuit, and the ejecting malfunction detection circuit; and a recovery mechanism executing a recovery process for recovery from the ejecting malfunction, wherein the switching circuit switches between electrically coupling the liquid ejecting head to the ejecting selection circuit and electrically coupling the liquid ejecting head to the ejecting malfunction detection circuit.

9. The liquid ejecting apparatus according to claim 8, wherein the recovery mechanism, as the recovery process, executes, when the cause of the ejecting malfunction is the air bubble entrance, a pump suction process of coupling a pump to a cap covering a nozzle surface on which the nozzle of the liquid ejecting head is provided, and performing suction, executes, when the cause of the ejecting malfunction is the dry thickening, the pump suction process or a flushing process of ejecting the liquid from the nozzle by driving the drive element for cleaning the liquid ejecting head, and executes, when the cause of the ejecting malfunction is the paper dust clinging, a wiping process of wiping the nozzle surface of the liquid ejecting head.

10. The liquid ejecting apparatus according to claim 9, wherein the recovery mechanism executes the recovery process on a malfunctioning nozzle in which the ejecting malfunction is detected in the ejecting malfunction detection circuit, the vibration plate corresponding to the malfunctioning nozzle is displaced after the execution of the recovery process, and the ejecting malfunction detection circuit detects the presence or absence of the ejecting malfunction of the malfunctioning nozzle again based on the residual vibration signal generated by the displacement of the vibration plate corresponding to the malfunctioning nozzle.

11. The liquid ejecting apparatus according to claim 9, wherein the recovery mechanism executes the flushing process on a malfunctioning nozzle in which the ejecting malfunction is detected in the ejecting malfunction detection circuit, the vibration plate corresponding to the malfunctioning nozzle is displaced after the execution of the flushing process, the ejecting malfunction detection circuit detects the presence or absence of the ejecting malfunction of the malfunctioning nozzle again and specifies the cause of the ejecting malfunction based on the residual vibration signal generated by the displacement of the vibration plate corresponding to the malfunctioning nozzle, and the recovery mechanism executes the recovery process corresponding to the cause of the ejecting malfunction specified by the ejecting malfunction detection circuit in the detection performed again.

12. The liquid ejecting apparatus according to claim 8, wherein a plurality of the liquid ejecting heads, a plurality of the ejecting malfunction detection circuits, and a plurality of the switching circuits, are provided, a first ejecting malfunction detection circuit of the plurality of ejecting malfunction detection circuits detects the presence or absence of the ejecting malfunction of the nozzle included in a first liquid ejecting head of the plurality of liquid ejecting heads and specifies the cause of the ejecting malfunction, a first switching circuit of the plurality of switching circuits switches between electrically coupling the first liquid ejecting head to the ejecting selection circuit and electrically coupling the first liquid ejecting head to the first ejecting malfunction detection circuit, a second ejecting malfunction detection circuit of the plurality of ejecting malfunction detection circuits detects the presence or absence of the ejecting malfunction of the nozzle included in a second liquid ejecting head of the plurality of liquid ejecting heads and specifies the cause of the ejecting malfunction, a second switching circuit of the plurality of switching circuits switches between electrically coupling the second liquid ejecting head to the ejecting selection circuit and electrically coupling the second liquid ejecting head to the second ejecting malfunction detection circuit, the ejecting selection circuit selects whether or not to supply the drive waveform signal to each of the drive element included in the first liquid ejecting head and the drive element included in the second liquid ejecting head, and the detection of the presence or absence of the ejecting malfunction of the nozzle included in the first liquid ejecting head and the specifying of the cause of the ejecting malfunction in the first ejecting malfunction detection circuit are performed in parallel with the detection of the presence or absence of the ejecting malfunction of the nozzle included in the second liquid ejecting head and the specifying of the cause of the ejecting malfunction in the second ejecting malfunction detection circuit.

13. The liquid ejecting apparatus according to claim 12, wherein the recovery mechanism executes the recovery process on the first liquid ejecting head depending on the cause of the ejecting malfunction detected by the first ejecting malfunction detection circuit, and executes the recovery process on the second liquid ejecting head depending on the cause of the ejecting malfunction detected by the second ejecting malfunction detection circuit.

14. The liquid ejecting apparatus according to claim 1, wherein the ejecting malfunction detection circuit detects the presence or absence of the ejecting malfunction and specifies the cause of the ejecting malfunction during an ejecting operation of ejecting the liquid from the nozzle.

15. A print head comprising:

a liquid ejecting head including a vibration plate, a drive element displacing the vibration plate by being supplied with a drive waveform signal, a cavity that is filled with a liquid and of which an internal pressure changes by the displacement of the vibration plate, and a nozzle that communicates with the cavity and that ejects the liquid by the change in internal pressure of the cavity; and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal, wherein the ejecting malfunction detection circuit includes a detection unit detecting the residual vibration signal, an obtaining unit obtaining information indicating an ejecting state of the liquid ejected from the nozzle, and a learning unit machine learning a relationship between the residual vibration signal and the ejecting state.

16. A print head comprising:

a liquid ejecting head including a vibration plate, a drive element displacing the vibration plate by being supplied with a drive waveform signal, a cavity that is filled with a liquid and of which an internal pressure changes by the displacement of the vibration plate, and a nozzle that communicates with the cavity and that ejects the liquid by the change in internal pressure of the cavity; and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal, wherein the ejecting malfunction detection circuit includes a detection unit detecting the residual vibration signal, a storage unit storing a learning model obtained by machine learning a relationship between the residual vibration signal and an ejecting state of the liquid ejected from the nozzle, and a determination unit determining the presence or absence of the ejecting malfunction of the liquid ejecting head based on the residual vibration signal and the learning model.

17. A liquid ejecting method of a liquid ejecting apparatus including a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal, the method comprising:

by the ejecting malfunction detection circuit, detecting the residual vibration signal;

obtaining information indicating an ejecting state of the liquid ejected from the nozzle; and machine learning a relationship between the residual vibration signal and the ejecting state.

18. A liquid ejecting method of a liquid ejecting apparatus including a drive signal generation circuit generating a drive waveform signal, a liquid ejecting head including a vibration plate, a drive element displacing the vibration plate by being supplied with the drive waveform signal, a cavity that is filled with a liquid and of which an internal pressure changes by the displacement of the vibration plate, and a nozzle that communicates with the cavity and that ejects the liquid by the change in internal pressure of the cavity, and an ejecting malfunction detection circuit that detects, as a residual vibration signal, a change of the vibration plate caused based on a change in pressure of the cavity after the supply of the drive waveform signal to the drive element and that detects presence or absence of an ejecting malfunction of the nozzle and specifies a cause of the ejecting malfunction based on the residual vibration signal, the method comprising:

by the ejecting malfunction detection circuit, detecting the residual vibration signal;

storing a learning model obtained by machine learning a relationship between the residual vibration signal and an ejecting state of the liquid ejected from the nozzle; and determining the presence or absence of the ejecting malfunction of the liquid ejecting head based on the residual vibration signal and the learning model.

* * * * *